US007052561B2

(12) United States Patent
Lu et al.

(10) Patent No.: US 7,052,561 B2
(45) Date of Patent: May 30, 2006

(54) BULK AMORPHOUS STEELS BASED ON FE ALLOYS

(75) Inventors: ZhaoPing Lu, Oak Ridge, TN (US); Chain T. Liu, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 283 days.

(21) Appl. No.: 10/639,377

(22) Filed: Aug. 12, 2003

(65) Prior Publication Data

US 2005/0034792 A1 Feb. 17, 2005

(51) Int. Cl.
*C22C 45/02* (2006.01)

(52) U.S. Cl. ..... 148/403; 420/40; 420/83

(58) Field of Classification Search ..... 148/304, 148/403; 420/12, 40, 83
See application file for complete search history.

(56) References Cited

U.S. PATENT DOCUMENTS 3,856,513 A * 12/1974 Chen et al. ..... 148/403
4,116,682 A * 9/1978 Polk et al. ..... 148/403
4,668,310 A * 5/1987 Kudo et al. ..... 148/304
4,945,339 A * 7/1990 Yamauchi et al. ..... 340/551
5,645,651 A 7/1997 Fujimura et al.
6,227,985 B1 5/2001 Mizushima et al.
6,280,536 B1 8/2001 Inoue et al.
6,284,061 B1 9/2001 Inoue et al.
6,296,681 B1 10/2001 Mizushima et al.
6,559,808 B1 * 5/2003 Petzold et al. ..... 343/787
6,623,566 B1 * 9/2003 Senkov et al. ..... 148/121
2003/0164209 A1 9/2003 Poon et al.

FOREIGN PATENT DOCUMENTS

WO WO 02/18667 3/2002
WO WO 2005/024075 3/2005

OTHER PUBLICATIONS

T. D. Shen et al, "Bulk Ferromagnetic Glasses Prepared by Flux Melting and Water Quenching." Appl. Phys. Lett., vol. 75 ( No. 1), p. 49-51, ( Jul. 5, 1999).
A. Inoue et al, "Bulk Amorphous Alloys with High mechanical Strength & Good Soft Magnetic Properties in Fe-TM-B(TM=IV-VIII Group Transition Metal) System," Appl. Phys. Lett., vol. 7 ( No. 4), p. 464-466, ( Jul. 28, 1997).

(Continued)

*Primary Examiner*—George Wyszomierski
(74) *Attorney, Agent, or Firm*—Joseph A. Marasco

(57) ABSTRACT

A bulk amorphous alloy has the approximate composition: $Fe_{(100-a-b-c-d-e)}Y_aMn_bT_cM_dX_e$ wherein: T includes at least one of the group consisting of: Ni, Cu, Cr and Co; M includes at least one of the group consisting of W, Mo, Nb, Ta, Al and Ti; X includes at least one of the group consisting of Co, Ni and Cr; a is an atomic percentage, and a<5; b is an atomic percentage, and b≦25; c is an atomic percentage, and c≦25; d is an atomic percentage, and d≦25; and e is an atomic percentage, and 5≦e≦30.

12 Claims, 18 Drawing Sheets

OTHER PUBLICATIONS

A. Inoue et al, "New Bulk Amorphous Fe-(Co,Ni)-M-B (M-Zr,Hf,Nb,Ta,Mo,W) Alloys with good Soft Magnetic Properties," J1 of Applied Physics, vol. 83 ( No. 11), p. 6326-6328, ( Jun. 1, 1998).

V. Ponnambalam, et al., "Synthesis of iron-based bulk metallic glasses as nonferromagnetic amorphous steel alloys," Applied Physics Lettes, 2003, vol. 83, No. 6.

* cited by examiner

BULK AMORPHOUS STEELS BASED ON FE ALLOYS

The United States Government has rights in this invention pursuant to contract no. DE-AC05-00OR22725 between the United States Department of Energy and UT-Battelle, LLC.

CROSS-REFERENCE TO RELATED APPLICATIONS

Specifically referenced is U.S. patent application Ser. No. 10/364,988 filed on Feb. 12, 2003 by ZhaoPing Lu and Chain T. Liu entitled "Fe-Based Metallic Glass for Structural and Functional Use", the entire disclosure of which is incorporated herein by reference.

FIELD OF THE INVENTION

The present invention relates to Fe-based bulk amorphous (glass) steel compositions, and more particularly to Fe-based bulk amorphous steel compositions containing Fe as a major component, Y and Mn, at least one of Ni, Cu, Cr and Co, at least one of C, B and Si, and at least one of Mo, W, Nb, Ta, Ti and Al, and which are characterized by enhanced glass-forming ability (GFA), high material strength, and low material cost.

BACKGROUND OF THE INVENTION

Although conventional steels with crystalline structure, containing various carbon levels, have been extensively utilized by industries, bulk amorphous steels having glassy microstructure show great potential to supercede crystalline steels for some structural and functional applications due to their superior properties, such as higher strength, better magnetic properties and better corrosion resistance. For example, some known bulk Fe based amorphous alloys have shown a hardness of above HV1200, which is twice that of the high-grade ultra-high strength steel (e.g. 18Ni Maraging 300).

It was also found that some known ferromagnetic Fe based bulk amorphous alloys have extremely high energy conversion efficiency when used as transformer cores of electrical transformers or other energy conversion devices. As a result, using these materials as cores can save up to ⅔ of total energy loss due to the heat dissipated by distribution transformers and motors with conventional ferromagnetic cores.

Moreover, compared with most of other bulk amorphous alloy systems such as Zr- and Pd-based, bulk amorphous steels also show some superiority: much lower material cost; higher strength; better magnetic properties; and higher thermal stability (glass transition temperature is close to or above 900 K)

However, one major obstacle to the feasibility of Fe based amorphous steels is their typically low GFA. Although thin ribbons with a thickness of <100 μm have been successfully utilized in many application fields, such limitations have prevented wide spread industrial application thereof.

Significant efforts have been recently devoted to synthesizing Fe-based bulk metallic glasses with enhanced GFA. One composition reported for bulk glass formation in Fe-base alloys containing carbon is $Fe_{43}Mo_{16}Cr_{16}C_{15}B_{10}$ which can only be cast into a rod with a diameter of 2.5 mm by injecting the molten alloy into a copper mold under high cooling rates and high-vacuum. Hence, it is necessary to improve the GFA of Fe-based alloys in order to enhance the ability thereof to form bulk glassy specimens under conventional industrial conditions, for example, commercial-grade charge materials, low vacuum furnace, conventional casting methods, etc. Thus, such alloys could be more viable for engineering applications.

The patent referenced above describes a new series of bulk amorphous alloys Fe—Zr—Y—(Co, Mo, Cr)—B that still contain significant amounts of costly materials such as Zr and Co. Moreover, the maximum cross-section size of fully glassy samples needs to be as larger. New and improved bulk amorphous alloys are needed which have higher GFA and lower materials costs such that the alloys are more economical and suitable for various applications.

OBJECTS OF THE INVENTION

Accordingly, objects of the present invention include the provision of new and improved Fe-based steel compositions that have high GFA, that are made with inexpensive materials, can be formed into articles having cross-sections of at least 8 to 12 mm, high strength, corrosion resistance, and reduced material cost. Further and other objects of the present invention will become apparent from the description contained herein.

SUMMARY OF THE INVENTION

In accordance with one aspect of the present invention, the foregoing and other objects are achieved by a bulk amorphous alloy having the approximate composition:

$$Fe_{(100-a-b-c-d-e)}Y_aMn_bT_cM_dX_e$$

wherein: T includes at least one of the group consisting of: Ni, Cu, Cr and Co; M includes at least one of the group consisting of W, Mo, Nb, Ta, Al and Ti; X includes at least one of the group consisting of Co, Ni and Cr; a is an atomic percentage, and $a<5$; b is an atomic percentage, and $b\leqq 25$; c is an atomic percentage, and $c\leqq 25$; d is an atomic percentage, and $d\leqq 25$; and e is an atomic percentage, and $5\leqq e\leqq 30$.

For a better understanding of the present invention, together with other and further objects, advantages and capabilities thereof, reference is made to the following disclosure and appended claims in connection with the above-described drawings.

DETAILED DESCRIPTION OF THE INVENTION

For purposes of this invention, a "fully" amorphous metallic glass (amorphous alloy) product is defined as a material which contains no less than 90% amorphous phase. This is a substantial and unexpected increase attributable to the compositions of the present invention. Frequently, materials produced in practice of the present invention comprise a single amorphous phase. The approximate chemical formula of the compositions of the present invention can be expressed as follows:

$$Fe_{(100-a-b-c-d-e)}Y_aMn_bT_cM_dX_e$$

In the above formula:

T is at least one of Ni, Cu, Cr and Co

M is one or plurality of W, Mo, Nb, Ta, Al and Ti

X is one or plurality of B, C and Si a, b, c, d and e are atomic percentages, wherein $$a<5$$

$$b\leqq 25$$

$$c\leqq 25$$

$$d\leqq 25$$

$$5\leqq e\leqq 30$$

It is preferable in the present invention that the element X is represented by:

$$C_fB_g$$

Wherein:

$$f+g=e$$

$$f<25$$

$$g<15$$

$$10\leqq e\leqq 25$$

More preferably, a very good glass-forming alloy within the composition range described above has the approximation formula:

$$Fe_{(100-a-b-h-i-f-g)}Y_aMn_bCr_hMo_iC_fB_g$$

In the above formula:

a, b, h, i, f and g are atomic percentages, wherein:

$0.5 \leqq a \leqq 3$ $1 \leqq b \leqq 15$ $3 \leqq h \leqq 17$ $2 \leqq i \leqq 17$ $5 \leqq f \leqq 20$ $2 \leqq g \leqq 9$ The above formulae are described as approximate because there can be small variation in constituent amounts—usually less than 1 at. %. Percent values expressed herein are atomic % (at. %) unless indicated otherwise.

Figure 1:
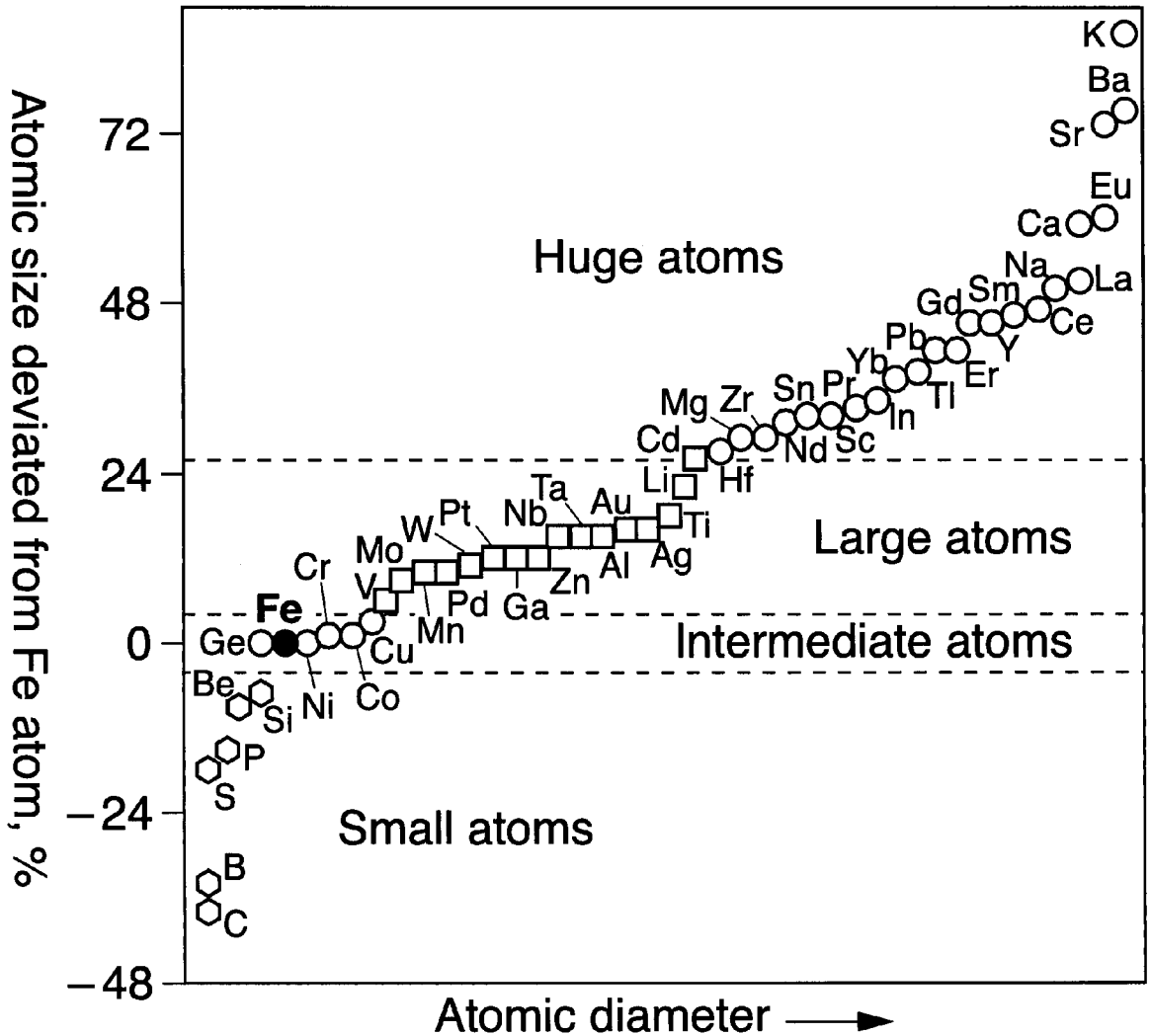
FIG. 1 is a graph comparing atomic diameters of candidate constituent elements for bulk Fe-based metallic glass compositions.

FIG. 1 shows comparative atomic diameters of candidate constituent elements for bulk Fe-based metallic glass compositions. A large difference in atomic size for the constituent elements possibly results in a high degree of dense random packed structure, which favors glass formation from both thermodynamic and kinetic points of view. On the other hand, oxygen is suspected to be an undesirable element, which may trigger the formation of crystalline phases in under-cooled liquids. In the present invention, elements with varying atomic sizes and varying affinity for oxygen were selected to add into the alloys, which are categorized below (also see FIG. 1) in terms of atomic sizes:

1) Huge atoms (their atomic volumes are doubled compared with that of Fe atom): Zr, Sn and rare earths like Y, La Nd and Ce
2) Large atoms: Mo, W, Nb, Ta, Al, Mn and Ti
3) Intermediate atoms: Cu, Co, Cr and Ni
4) Small atoms: B, Si and C It should be pointed out that glass formation is a complex phenomenon that is affected by various interactions among most or all of the constituent elements. The above-mentioned considerations are general, empirical guidelines for searching new glass forming compositions. Experimentation has produced the following results:

Effect of Huge Atoms

Table 1 is a listing of alloy compositions prepared for the present invention. Compared with Fe atoms, the atomic radii of rare earth elements are generally "huge", as shown in FIG. 1. The addition of certain huge elements, for example, Nd, La and Ce, in Fe-based alloys is usually expected to generate uni-axial magnetic anisotropy and increase cohesive force, resulting in often-desirable magnetic properties of the resulting alloy.

Figure 2A:
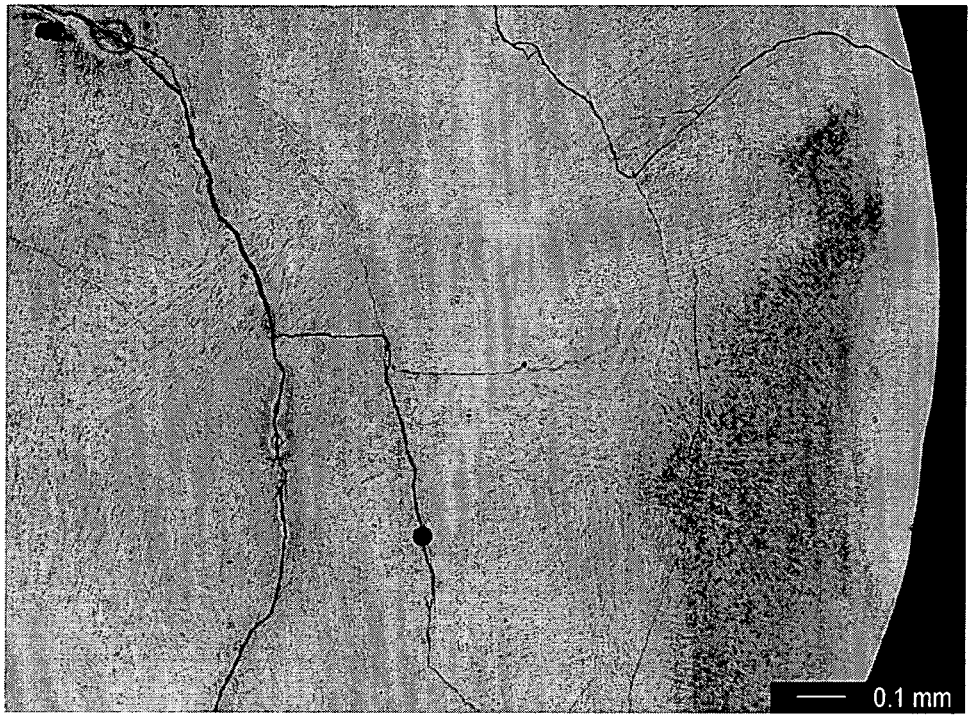
FIG. 2*a* is a photomicrograph showing the morphology of the edge region of a transverse cross-section of a 7 mm, drop-cast, base alloy of the formula $Fe_{50}Mo_{14}Mn_{10}Cr_4C_{16}B_6$.
Figure 2B:
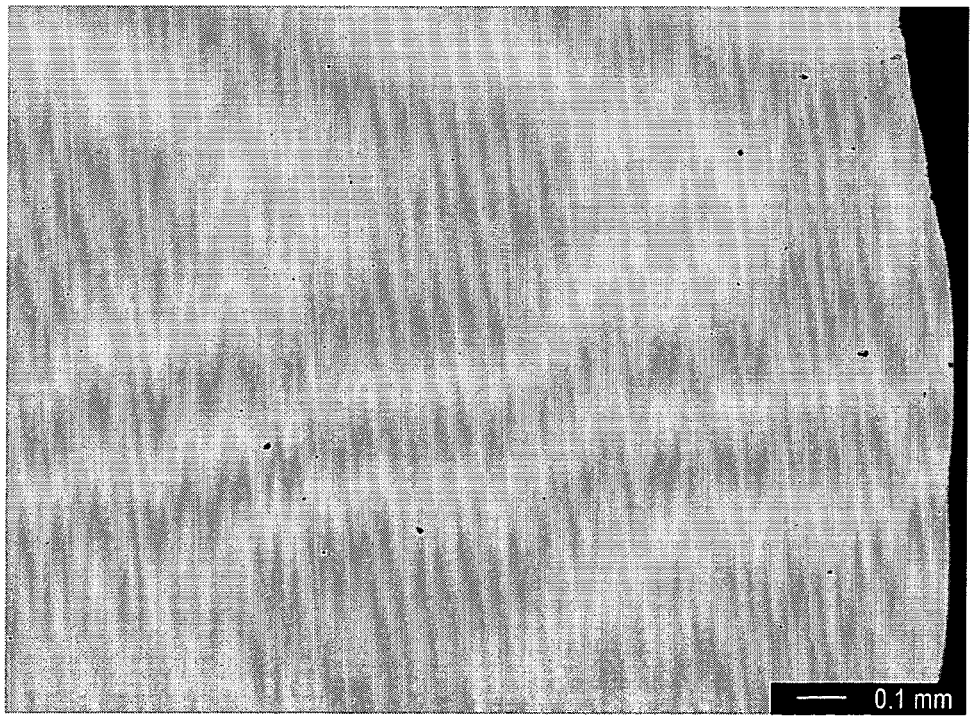
FIG. 2*b* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=0.9, in accordance with the present invention.
Figure 2C:
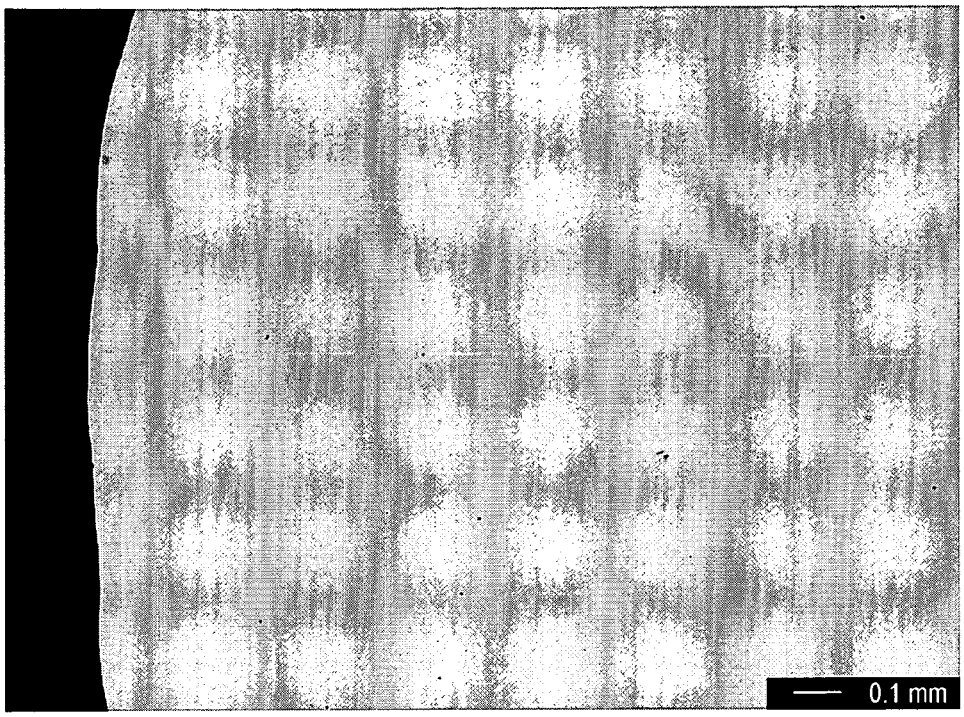
FIG. 2*c* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=1.2, in accordance with the present invention.
Figure 2D:
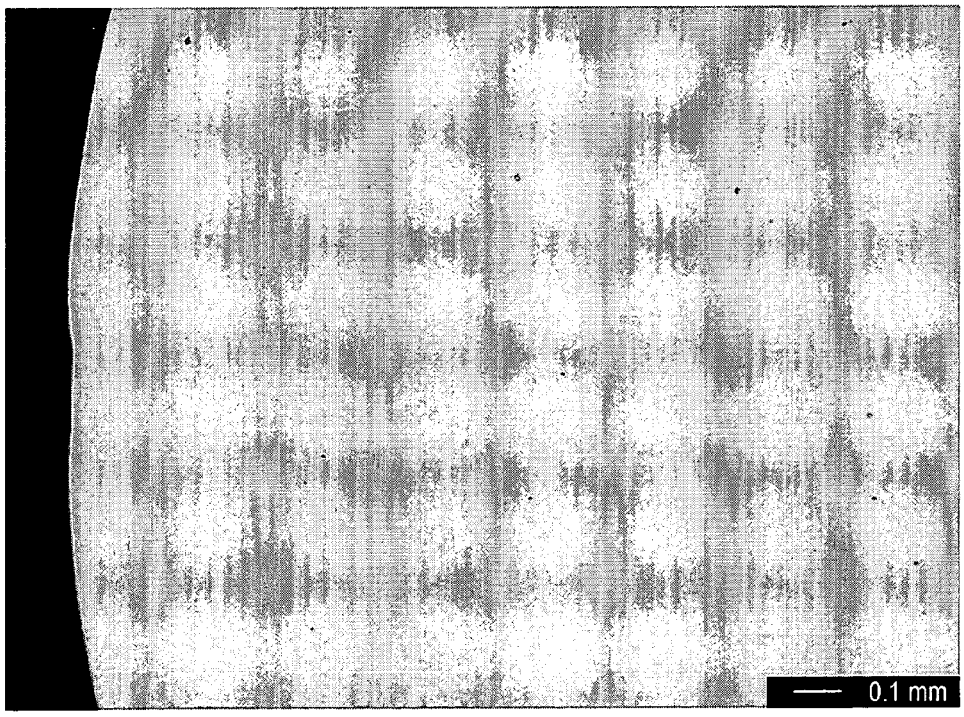
FIG. 2*d* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=1.5, in accordance with the present invention.
Figure 2E:
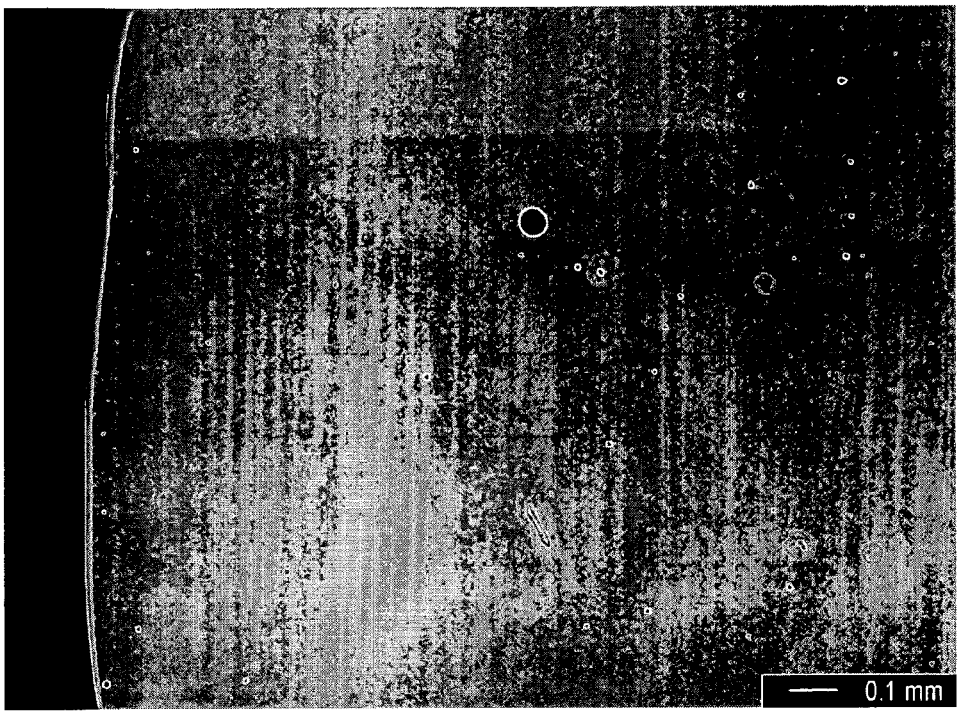
FIG. 2*e* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=2.2, in accordance with the present invention.
Figure 2F:
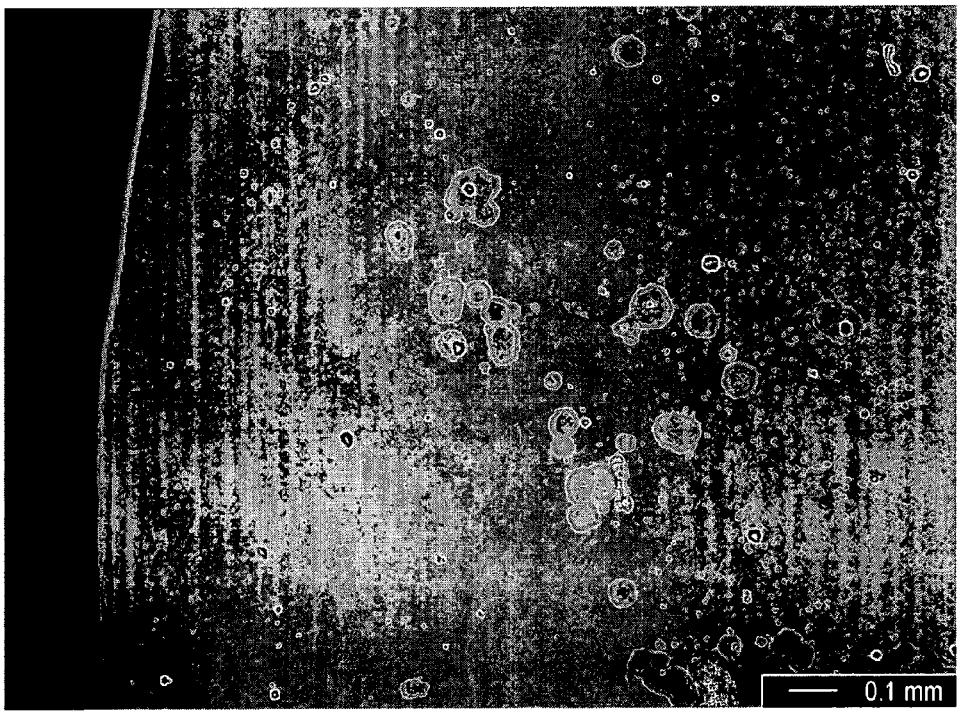
FIG. 2*f* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=2.9, in accordance with the present invention.
Figure 2G:
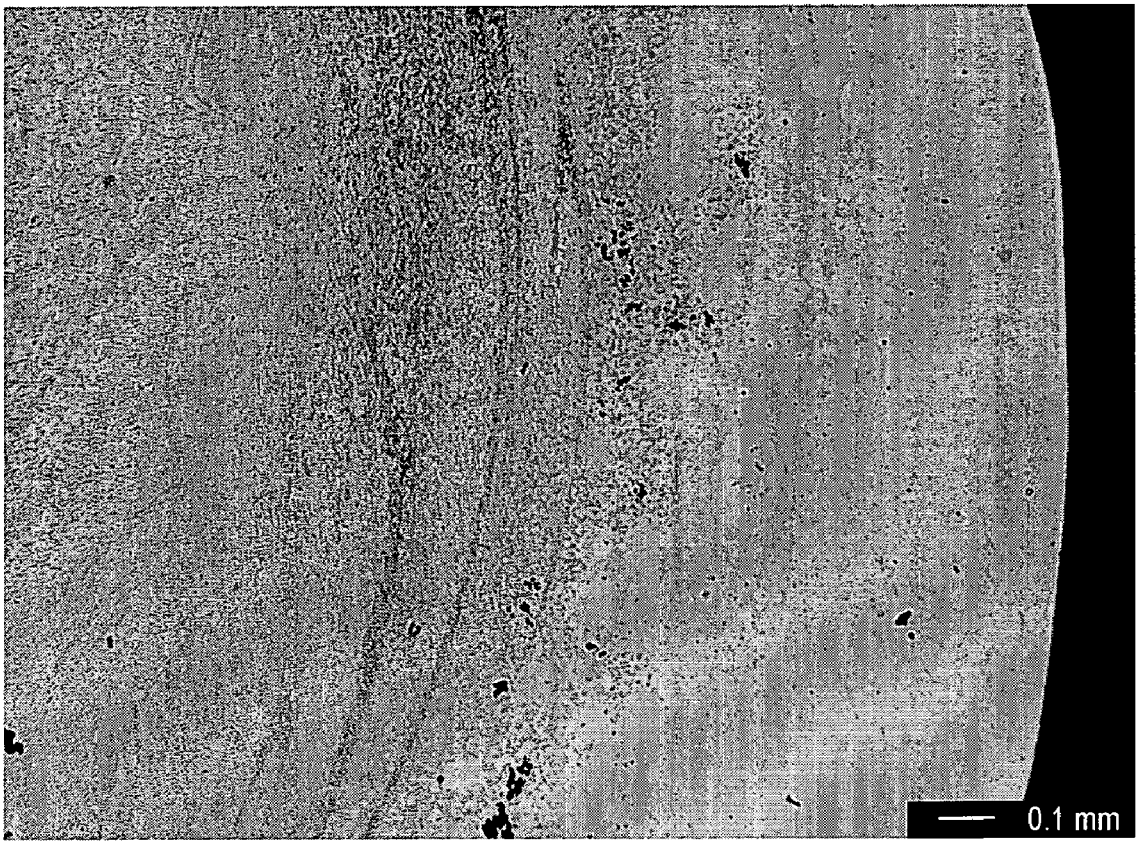
FIG. 2*g* is a photomicrograph showing the morphology of the edge region of a transverse cross-section of a 7 mm, drop-cast, base alloy of the formula $(Fe_{50}Mo_{14}Mn_{10}Cr_4C_{16}B_6)_{100-x}Y_x$ where x=3.8, in accordance with the present invention.
Figure 3A:
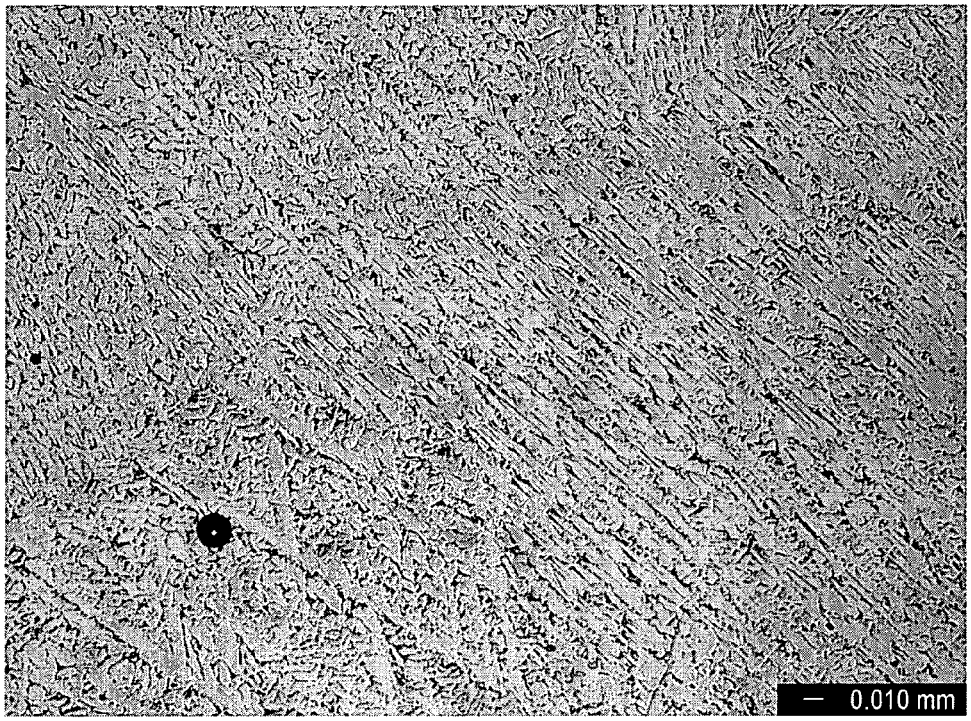
FIG. 3*a* is a photomicrograph showing the morphology of the center of a transverse cross-section of a 7 mm, drop-cast alloy of the formula $Fe_{50}Mo_{14}Mn_{10}Cr_4C_{16}B_6$.
Figure 3B:
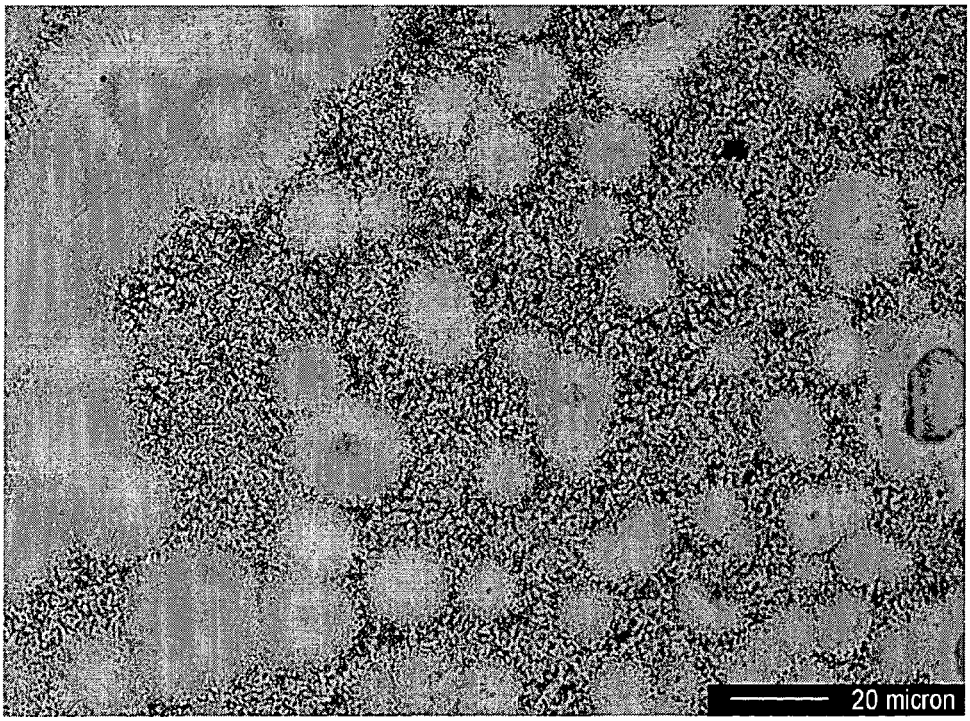
FIG. 3*b* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=0.9, in accordance with the present invention.
Figure 3C:
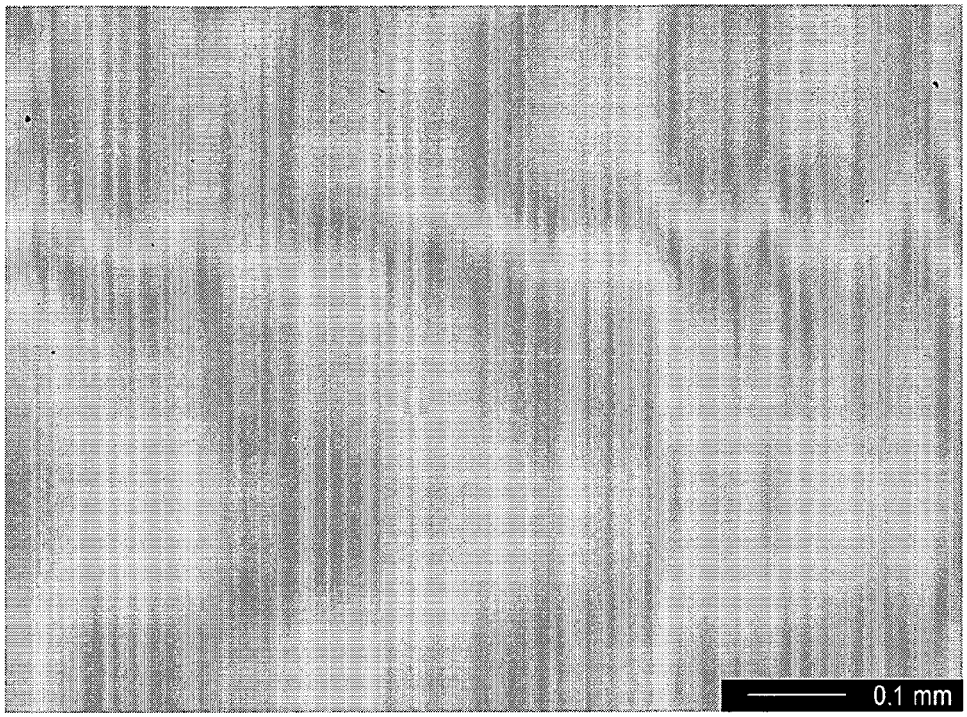
FIG. 3*c* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=1.2, in accordance with the present invention.
Figure 3D:
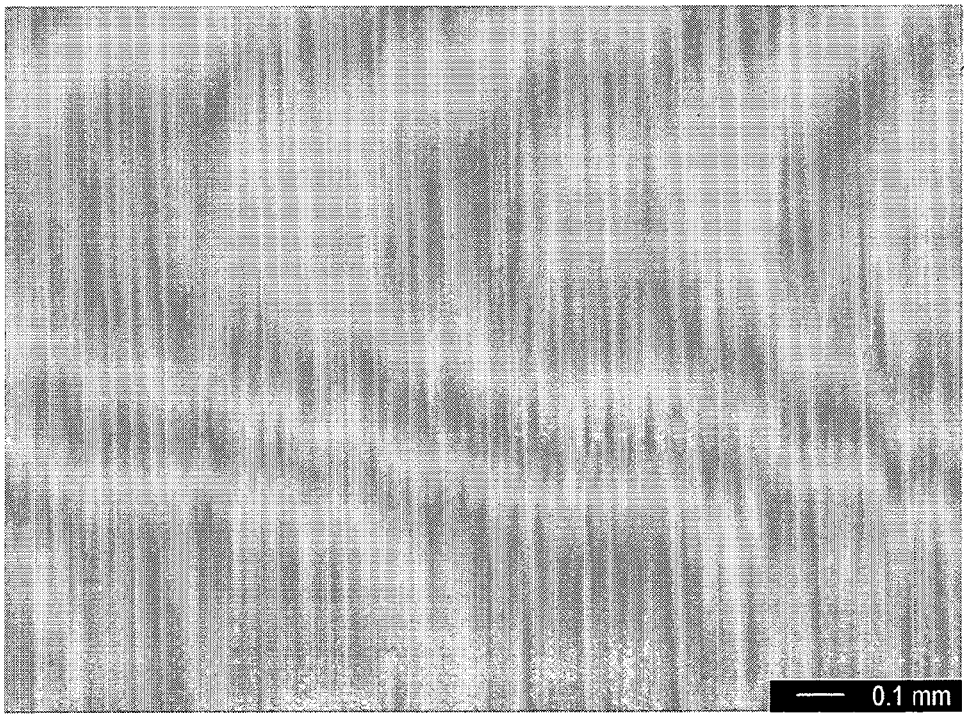
FIG. 3*d* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=1.5, in accordance with the present invention.
Figure 3E:
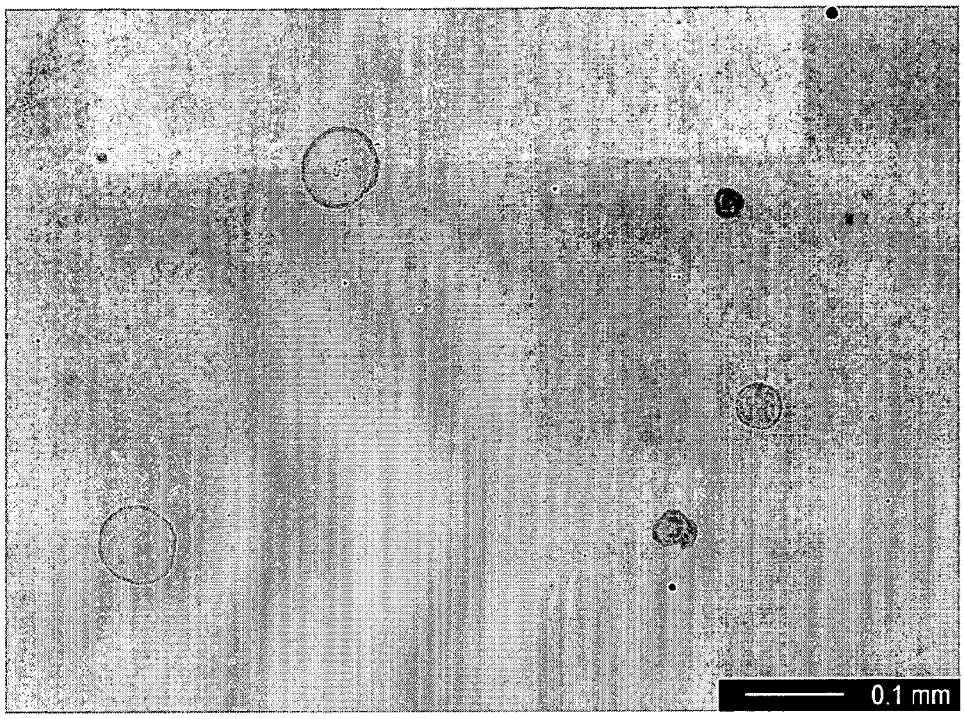
FIG. 3*e* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=2.2, in accordance with the present invention.
Figure 3F:
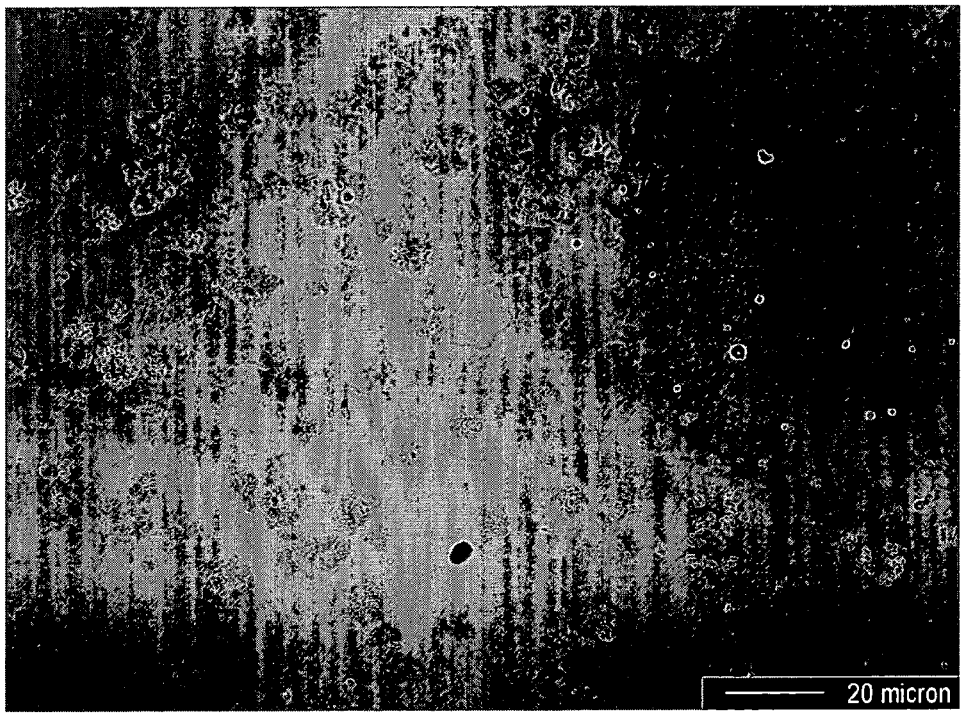
FIG. 3*f* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=2.9, in accordance with the present invention.
Figure 3G:
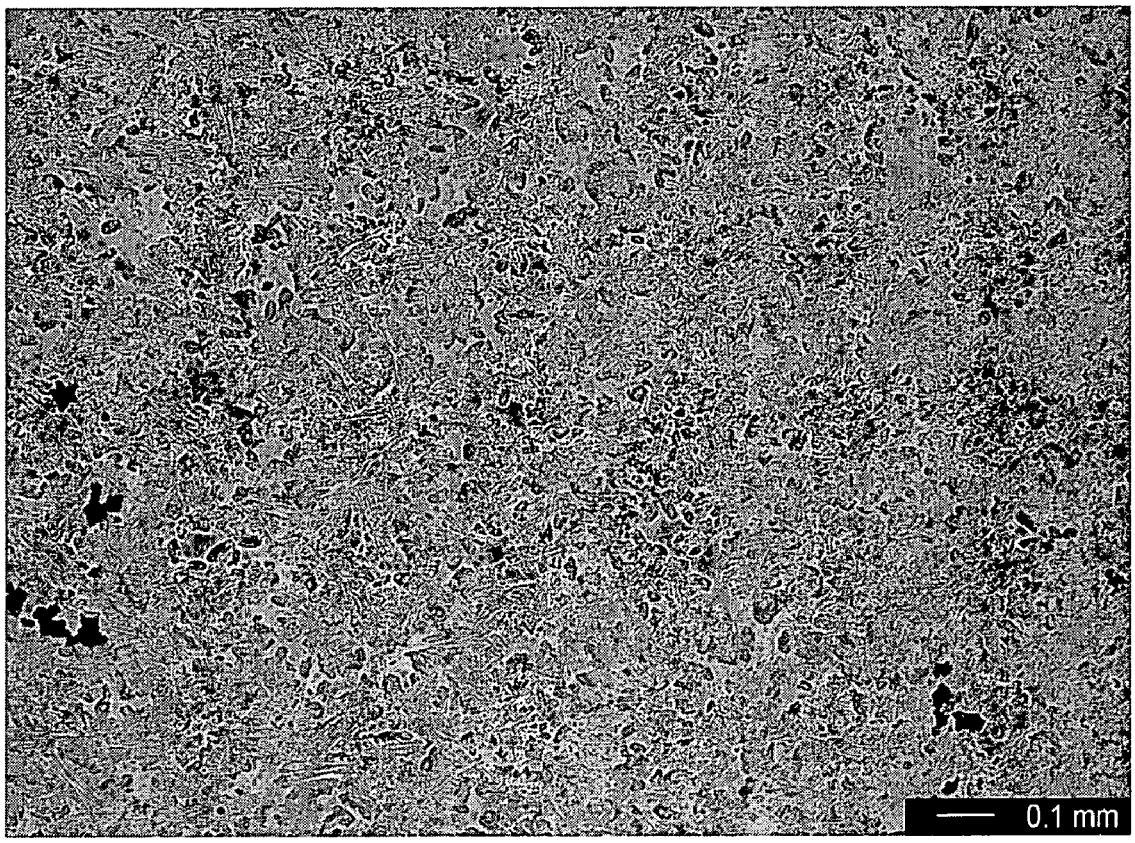
FIG. 3*g* is a photomicrograph showing the morphology of the center of a transverse cross-section of a 7 mm, drop-cast alloy of the formula $(Fe_{50}Mo_{14}Mn_{10}Cr_4C_{16}B_6)_{100-x}Y_x$ where x=3.8, in accordance with the present invention.

Normally, an effective compositional range of huge elements would be from 5 to 15 atomic percentages. However, in the present invention, the addition of a lesser amount of element Y is shown to enhance GFA remarkably. FIGS. 2*a*–2*g* and 3*a*–3*g* show edge and central part of transverse cross-sections of drop-cast samples with various amounts Y, respectively, demonstrating a dramatic effect of yttrium on glass formation in the system $(Fe_{50}Mo_{14}Mn_{10}Cr_4C_{16}B_6)_{100-x}Y_x$. In FIGS. 2*a*–2*g* and 3*a*–3*g*, x=0, 0.9, 1.2, 1.5, 2.2, 2.9, and 3.8%, respectively. With no Y addition (FIGS. 2*a*, 3*a*), the sample showed a small amorphous region close to the edge where the highest cooling rate is located. However, the common dendrite structures were observed over most of areas in the sample. With the addition of 0.9% yttrium (FIG. 2*b*), a large area of featureless structure (amorphous structure) was seen in the region close to edge, although fully crystalline structure was still present in the central part of the specimen (FIG. 3*b*), indicating that the GFA of this alloy has been greatly improved. As the content of yttrium was further increased to 1.2% and 1.5%, the samples displayed typical featureless structures over the whole cross-sections, implying that fully amorphous structures were obtained in these two alloys. However, when yttrium content exceeds 2.2%, some kinds of spherical primary phases began to appear in both edge and center areas, as shown in FIGS. 2*e* and 3*e*, respectively. With the further increasing of yttrium, the precipitation of the spherical crystalline phases increased until the amorphous structure completely disappeared, as shown in FIGS. 2*f*, 3*f*, 2*g* and 3*g*. It is therefore concluded that the Y content should not exceed 4% for glass formation in this particular Fe based system as far as the GFA is concerned.

Figure 4A:
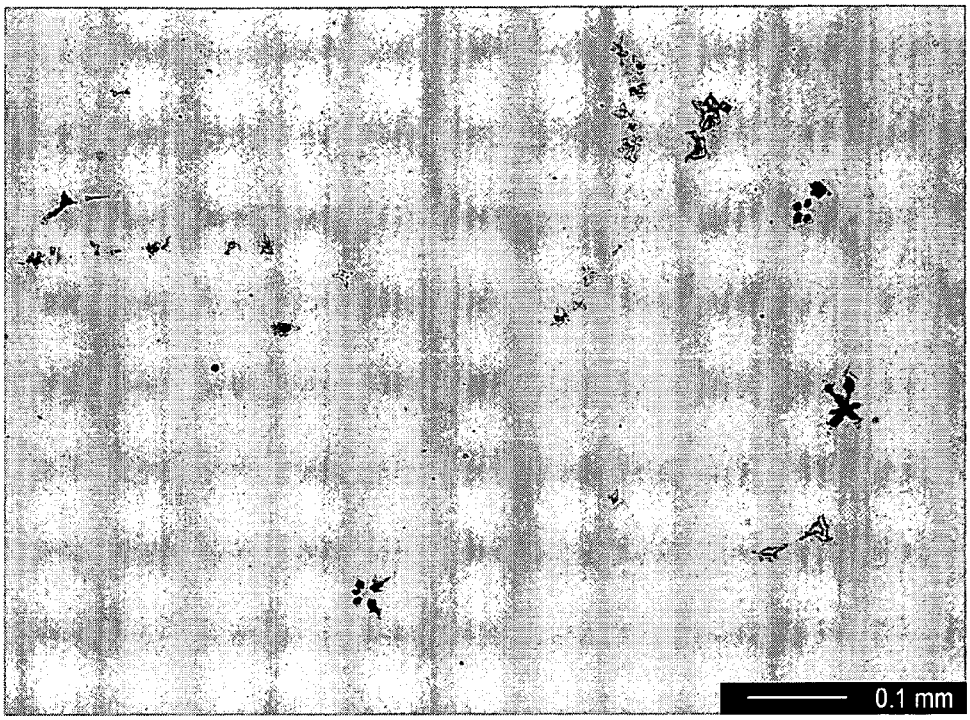
FIG. 4*a* is a photomicrograph showing the morphology of a transverse cross-section of a 7 mm, drop-cast, base alloy of the formula $Fe_{42.1}Y_2Mo_{15.7}Cr_{15.7}C_{14.7}B_{9.8}$, in accordance with the present invention.
Figure 4B:
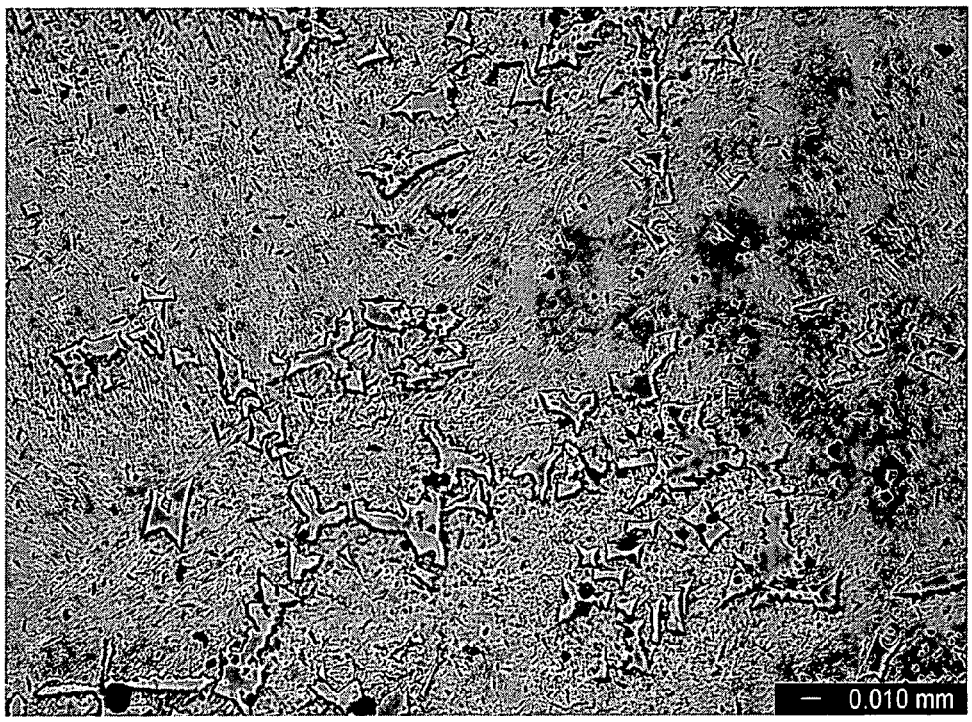
FIG. 4*b* is a photomicrograph showing the morphology of a transverse cross-section of a 7 mm, drop-cast, base alloy of the formula $(Fe_{42.1}Y_2Mo_{15.7}Cr_{15.7}C_{14.7}B_{9.8})_{99}Sn_1$, in accordance with the present invention.

Some other huge elements, for example, Sn do not appear to be as effective as Y in promoting glass formation in these Fe based alloys. FIGS. 4*a*–b are photomicrographs of the central part of the transverse cross-section of the samples doped with Sn and drop cast with 7 mm diameter copper mold, demonstrating the adverse effect of Sn on glass formation in system $(Fe_{42.1}Y_2Mo_{15.7}Cr_{15.7}C_{14.7}B_{9.8})_{100-x}Sn_x$ (x=0 and 1%, respectively). When no Sn was doped, the alloy (alloy 1 in Table I) exhibited a featureless structure with some dispersions of primary phases (FIG. 4*a*). However, when 1% Sn was added in this alloy, the matrix appeared as fine lamellae instead of the desired amorphous structure, although similar primary phases are present (FIG. 4*b*).

TABLE I

| No | Formula | Composition, at. % | Size mm | Optical Results |
|---|---|---|---|---|
| 1 | $(Fe_{43}Mo_{16}Cr_{16}C_{15}B_{10})_{98}Y_2$ | $Fe_{42.1}Y_2Mo_{15.7}Cr_{15.7}C_{14.7}B_{9.8}$ | 5 | Fully amorphous |
| | | | 7 | Fully amorphous |
| 2 | $(Fe_{43}Mo_{16}Cr_{16}C_{13}B_{10})_{98}Y_2$ | $Fe_{43}Y_2Mo_{16}Cr_6C_{13}B_{10}$ | 7 | Partial amorphous |
| 3 | $(Fe_{43}Mo_{16}Cr_{16}C_{14}B_{10})_{98}Y_2$ | $Fe_{42.6}Y_2Mo_{15.8}Cr_{15.8}C_{13.9}B_{9.9}$ | 7 | Fully amorphous |
| 4 | $(Fe_{43}Mo_{15}Cr_{15}Nb_2C_{15}B_{10})_{98}Y_2$ | $Fe_{42.1}Y_2Nb_2Mo_{14.7}Cr_{14.7}C_{14.7}B_{9.8}$ | 7 | Partial amorphous |
| 5 | $Fe_{43}Mo_{16}Cr_{16}C_{15}B_{10}$ | $Fe_{43}Mo_{16}Cr_{16}C_{15}B_{10}$ | 5 | Partial amorphous |
| 6 | $(Fe_{43}Mo_{15.5}Cr_{15.5}C_{16}B_{10})_{98}Y_2$ | $Fe_{42.1}Y_2Mo_{15.2}Cr_{15.2}C_{15.7}B_{9.8}$ | 7 | Partial amorphous |
| 7 | $Fe_{43}Y_2Mo_{16}Cr_{14}C_{15}B_{10}$ | $Fe_{43}Y_2Mo_{16}Cr_{14}C_{15}B_{10}$ | 7 | Partial amorphous |
| 8 | $(Fe_{43}Y_2Mo_{16}Cr_{16}C_{15}B_{10})_{99}Sn_1$ | $Fe_{42.1}Y_2Nb_2Mo_{14.7}Cr_{14.7}C_{14.7}B_{9.8}$ | 7 | Fully crystalline |
| 9 | $Fe_{50}Mn_{10}Mo_{14}Cr_4C_{16}B_6$ | $Fe_{50}Mn_{10}Mo_{14}Cr_4C_{16}B_6$ | 5 | Fully crystalline |
| 10 | $(Fe_{50}Mo_{14}Mn_{10}Cr_4C_{16}B_6)_{98}Y_2$ | $Fe_{49}Y_2Mn_{9.8}Mo_{13.7}Cr_{3.9}C_{15.7}B_{5.9}$ | 5 | Fully amorphous |
| | | | 7 | Fully amorphous |

TABLE I-continued

| No | Formula | Composition, at. % | Size mm | Optical Results |
|---|---|---|---|---|
| 11 | $(Fe_{43}Mo_{16}Cr_{12}Mn_4C_{15}B_{10})_{98}Y_2$ | $Fe_{42.1}Y_2Mn_{3.9}Mo_{15.7}Cr_{11.8}C_{14.7}B_{9.8}$ | 7 | Partial amorphous |
| 12 | $(Fe_{43}Mo_{16}Cr_8Mn_8C_{15}B_{10})_{98}Y_2$ | $Fe_{42.1}Y_2Mn_{7.8}Mo_{15.7}Cr_{7.8}C_{14.7}B_{9.8}$ | 7 | Partial amorphous |
| 13 | $(Fe_{43}Mo_{16}Cr_4Mn_{12}C_{15}B_{10})_{98}Y_2$ | $Fe_{42.1}Y_2Mn_{11.8}Mo_{15.7}Cr_{3.9}C_{14.7}B_{9.8}$ | 7 | Fully crystalline |
| 14 | $Fe_{61}Zr_8Mo_{12}Mn_{10}Cr_2B_{15}Y_2$ | $Fe_{55.5}Zr_{7.3}Y_{1.8}Mn_{9.1}Mo_{10.9}Cr_{1.8}B_{13.6}$ | 7 | Fully crystalline |
| 15 | $(Fe_{50}Mo_{14}Mn_{10}Cr_4C_{16}B_6)_{98.5}Y_{1.5}$ | $Fe_{49.2}Y_{1.5}Mn_{9.9}Mo_{13.8}Cr_{3.9}C_{15.8}B_{5.9}$ | 7 | Fully amorphous |
| | | | 12 | Partial amorphous |
| 16 | $(Fe_{50}Mo_{14}Mn_{10}Cr_4C_{16}B_6)_{98.2}Y_{1.8}$ | $Fe_{49.1}Y_{1.8}Mn_{9.8}Mo_{13.8}Cr_{3.9}C_{15.7}B_{5.9}$ | 7 | Fully amorphous |
| 17 | $(Fe_{50}Mo_{14}Mn_{10}Cr_4C_{16}B_6)_{97.8}Y_{2.2}$ | $Fe_{48.9}Y_{2.2}Mn_{9.8}Mo_{13.7}Cr_{3.9}C_{15.6}B_{5.9}$ | 7 | Fully amorphous |
| 18 | $(Fe_{50}Mo_{14}Mn_{10}Cr_4C_{16}B_6)_{97.5}Y_{2.5}$ | $Fe_{48.7}Y_{2.5}Mn_{9.7}Mo_{13.6}Cr_{3.9}C_{15.6}B_{5.8}$ | 7 | Partial amorphous |
| 19 | $(Fe_{50}Mo_{14}Mn_{10}Cr_4C_{16}B_6)_{97.1}Y_{2.9}$ | $Fe_{48.5}Y_{2.9}Mn_{9.7}Mo_{13.6}Cr_{3.9}C_{15.5}B_{5.8}$ | 7 | Partial amorphous |
| 20 | $(Fe_{50}Mo_{14}Mn_{10}Cr_4C_{16}B_6)_{98.8}Y_{1.2}$ | $Fe_{49.4}Y_{1.2}Mn_{9.9}Mo_{13.8}Cr_4C_{15.8}B_{5.9}$ | 7 | Fully amorphous |
| 21 | $(Fe_{50}Mo_{14}Mn_{10}Cr_4C_{16}B_6)_{99.1}Y_{0.9}$ | $Fe_{49.6}Y_{0.9}Mn_{9.9}Mo_{13.9}Cr_4C_{15.9}B_{5.9}$ | 7 | Partial amorphous |
| 22 | $(Fe_{50}Mo_{14}Cr_4C_{16}B_6Y_{1.5})_{89.3}Mn_{10.7}$ | $Fe_{48.8}Y_{1.5}Mn_{10.7}Mo_{13.7}Cr_{3.9}C_{15.6}B_{5.8}$ | 7 | Fully amorphous |
| | | | 12 | Fully amorphous |
| 23 | $(Fe_{50}Mo_{14}Mn_{10}Cr_4C_{16}B_6)_{96.2}Y_{3.8}$ | $Fe_{48.1}Y_{3.8}Mn_{9.6}Mo_{13.5}Cr_{3.8}C_{15.4}B_{5.8}$ | 7 | Fully crystalline |
| 24 | $(Fe_{48}Mo_{15}Mn_{10.7}Cr_{4.3}C_{16}B_6)_{98.5}Y_{1.5}$ | $Fe_{47.3}Y_{1.5}Mn_{10.5}Mo_{14.8}Cr_{4.2}C_{15.8}B_{5.9}$ | 7 | Partial amorphous |
| 25 | $(Fe_{48}Mo_{14}Mn_{10}Cr_4C_{17.5}B_{6.5})_{98.5}Y_{1.5}$ | $Fe_{51.2}Y_{1.5}Mn_{9.2}Mo_{12.8}Cr_{3.6}C_{15.8}B_{5.9}$ | 7 | Partial amorphous |
| 26 | $(Fe_{52}Mo_{14}Mn_{10}Cr_4C_{14.5}B_{5.5})_{98.5}Y_{1.5}$ | $Fe_{47.3}Y_{1.5}Mn_{9.9}Mo_{13.8}Cr_{3.9}C_{17.2}B_{6.4}$ | 7 | Partial amorphous |
| 27 | $(Fe_{50}Mo_{14}Cr_4C_{16}B_6Y_{1.5})_{88.1}Mn_{11.9}$ | $Fe_{48.2}Y_{1.4}Mn_{11.9}Mo_{13.5}Cr_{3.8}C_{15.4}B_{5.8}$ | 12 | Fully crystalline |
| 28 | $(Fe_{50}Mo_{14}Cr_4C_{16}B_6Y_{1.5})_{86.1}Mn_{13.9}$ | $Fe_{47}Y_{1.4}Mn_{13.9}Mo_{13.2}Cr_{3.8}C_{15.1}B_{5.6}$ | 12 | Fully crystalline |
| 29 | $Fe_{50}Mo_{14}Mn_{10}Cr_4Y_{1.5}(C_{16}B_6)_{21.5}Si_{0.5}$ | $Fe_{49.2}Y_{1.5}Si_{0.5}Mn_{9.9}Mo_{13.8}Cr_{3.9}C_{15.4}B_{5.8}$ | 12 | Fully amorphous |
| 30 | $Fe_{50}Mo_{14}Mn_{10}Cr_4Y_{1.5}(C_{16}B_6)_{20.5}Si_{1.5}$ | $Fe_{49.2}Y_{1.5}Si_{1.5}Mn_{9.9}Mo_{13.8}Cr_{3.9}C_{14.7}B_{5.5}$ | 12 | Partial amorphous |
| 31 | $(Fe_{48}Mo_{14}Mn_{11}Cr_6C_{16}B_6)_{98.5}Y_{1.5}$ | $Fe_{46.8}Y_{1.5}Mn_{10.7}Mo_{13.7}Cr_{5.9}C_{15.6}B_{5.8}$ | 12 | Fully amorphous |
| 32 | $(Fe_{46}Mo_{14}Mn_{11}Cr_8C_{16}B_6)_{98.5}Y_{1.5}$ | $Fe_{44.8}Y_{1.5}Mn_{10.7}Mo_{13.7}Cr_{7.9}C_{15.6}B_{5.8}$ | 12 | Fully amorphous |
| 33 | $(Fe_{44}Mo_{14}Mn_{11}Cr_{10}C_{16}B_6)_{98.5}Y_{1.5}$ | $Fe_{42.8}Y_{1.5}Mn_{10.7}Mo_{13.7}Cr_{9.9}C_{15.6}B_{5.8}$ | 12 | Fully amorphous |
| 34 | $(Fe_{44}Mo_{12}Mn_{11}Cr_{12}C_{16}B_6)_{98.5}Y_{1.5}$ | $Fe_{42.8}Y_{1.5}Mn_{10.7}Mo_{11.7}Cr_{11.9}C_{15.6}B_{5.8}$ | 12 | Partial amorphous |
| 35 | $(Fe_{45}Mo_{13}Mn_{11}Cr_{10}C_{16}B_6)_{98.5}Y_{1.5}$ | $Fe_{43.8}Y_{1.5}Mn_{10.7}Mo_{12.7}Cr_{9.9}C_{15.6}B_{5.8}$ | 12 | Fully amorphous |
| 36 | $(Fe_{45}Mo_{13}Mn_{11}Cr_8Co_2C_{16}B_6)_{98.5}Y_{1.5}$ | $Fe_{43.8}Y_{1.5}Mn_{10.7}Mo_{12.7}Cr_8Co_{1.9}C_{15.6}B_{5.8}$ | 12 | Fully amorphous |
| 37 | $(Fe_{41}Mo_{13}Mn_{11}Cr_{10}Co_4C_{16}B_6)_{98.5}Y_{1.5}$ | $Fe_{40}Y_{1.5}Mn_{10.7}Mo_{12.7}Cr_{9.9}Co_{3.8}C_{15.6}B_{5.8}$ | 12 | Fully amorphous |
| 38 | $(Fe_{45}Mo_{13}Mn_{11}Cr_7Co_3C_{16}B_6)_{98.5}Y_{1.5}$ | $Fe_{43.8}Y_{1.5}Mn_{10.7}Mo_{12.7}Cr_7Co_{2.9}C_{15.6}B_{5.8}$ | 12 | Fully amorphous |
| 39 | $(Fe_{45}Mo_{13}Mn_{11}Cr_6Co_4C_{16}B_6)_{98.5}Y_{1.5}$ | $Fe_{43.8}Y_{1.5}Mn_{10.7}Mo_{12.7}Cr_6Co_{3.9}C_{15.6}B_{5.8}$ | 12 | Fully amorphous |
| 40 | $(Fe_{45}Mo_{13}Mn_{11}Cr_6Co_3Zr_1C_{16}B_6)_{98.5}Y_{1.5}$ | $Fe_{43.8}Y_{1.5}Mn_{10.7}Mo_{12.7}Cr_6Co_{2.9}Zr_1C_{15.6}B_{5.8}$ | 12 | Fully amorphous |
| 41 | $(Fe_{45}Mo_{13}Mn_{11}Cr_5Co_5C_{16}B_6)_{98.5}Y_{1.5}$ | $Fe_{43.8}Y_{1.5}Mn_{10.7}Mo_{12.7}Cr_5Co_{4.9}C_{15.6}B_{5.8}$ | 12 | Fully amorphous |
| 42 | $(Fe_{44}Mo_{13}Mn_{11}Cr_5Co_6C_{16}B_6)_{98.5}Y_{1.5}$ | $Fe_{42.8}Y_{1.5}Mn_{10.7}Mo_{12.7}Cr_5Co_{5.9}C_{15.6}B_{5.8}$ | 12 | Partial amrophous |
| 43 | $(Fe_{45}Mo_{13}Mn_{11}Cr_4Co_6C_{16}B_6)_{98.5}Y_{1.5}$ | $Fe_{43.8}Y_{1.5}Mn_{10.7}Mo_{12.7}Cr_4Co_{5.9}C_{15.6}B_{5.8}$ | 12 | Fully amorphous |

Effects of Large Atoms

Figure 5A:
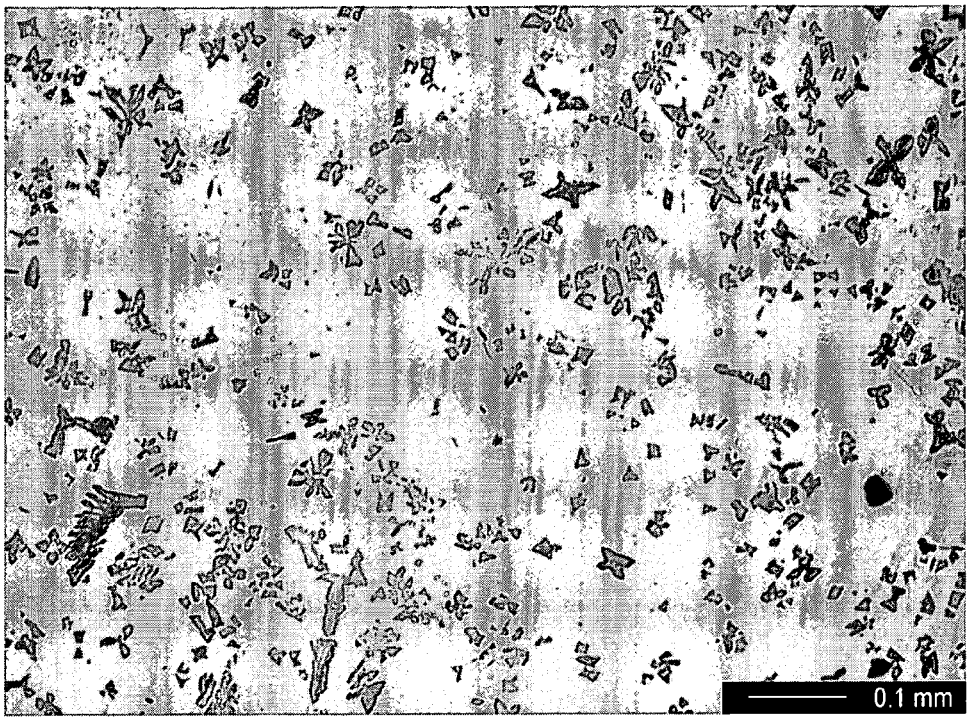
FIG. 5*a* is a photomicrograph showing the morphology of a transverse cross-section of a 7 mm, drop-cast, base alloy of the formula $(Fe_{43}Mo_{16}Mn_4Cr_{12}C_{15}B_{10})_{98}Y_2$, in accordance with the present invention.
Figure 5B:
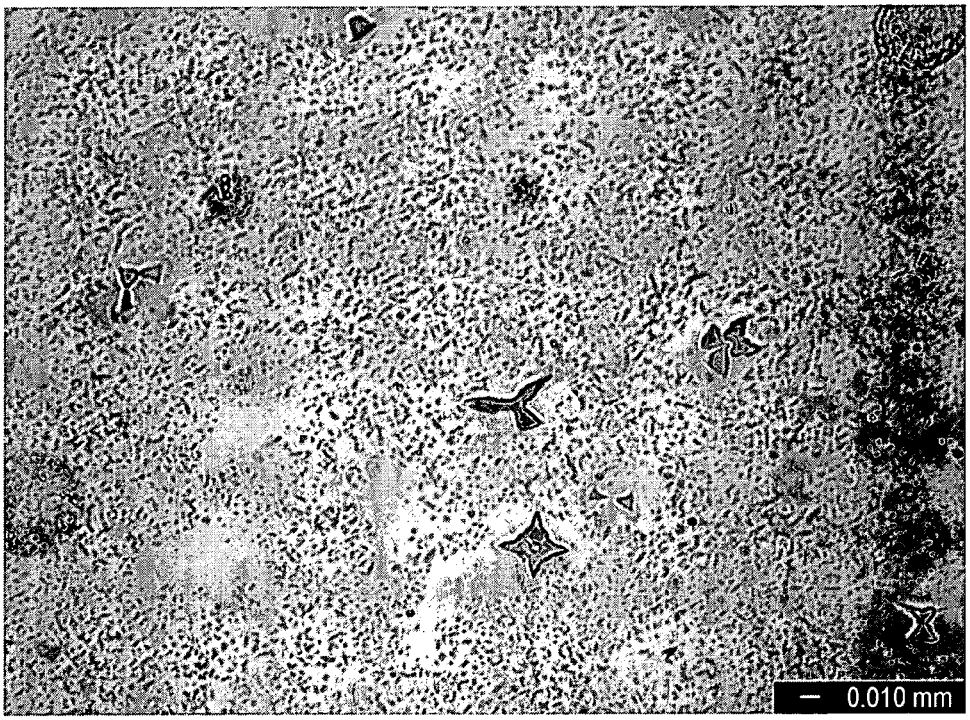
FIG. 5*b* is a photomicrograph showing the morphology of a transverse cross-section of a 7 mm, drop-cast, base alloy of the formula $(Fe_{43}Mo_{16}Mn_8Cr_8C_{15}B_{10})_{98}Y_2$, in accordance with the present invention.

In the present invention, addition of some Mn was found to promote glass formation. The effectiveness of Mn addition was found to have a connection to the content of B. For example, in the alloy system $(Fe_{43}Mo_{16}Mn_xCr_{16-x}C_{15}B_{10})_{98}Y_2$ with a boron content of 10% (alloys 1, 11, 12 and 13), additions of Mn appeared to decrease GFA, as shown in FIG. 5 which depicted the microphotographs of the central part of the cross-sections of drop-cast 7 mm specimens of these alloys. Without Mn addition, the 7 mm drop-cast rod showed a large volume of amorphous structure (see FIG. 4*a*). However, the volume fraction of amorphous structure was much decreased with the addition of 4% Mn, as shown in FIG. 5*a*. In a sample wherein the Mn content was increased to 8%, no amorphous structure was apparent in the central part of the rod, as shown in FIG. 5*b*. Crystalline structure was seen for alloys having greater than 10% Mn along with or greater than 10% B.

Figure 6A:
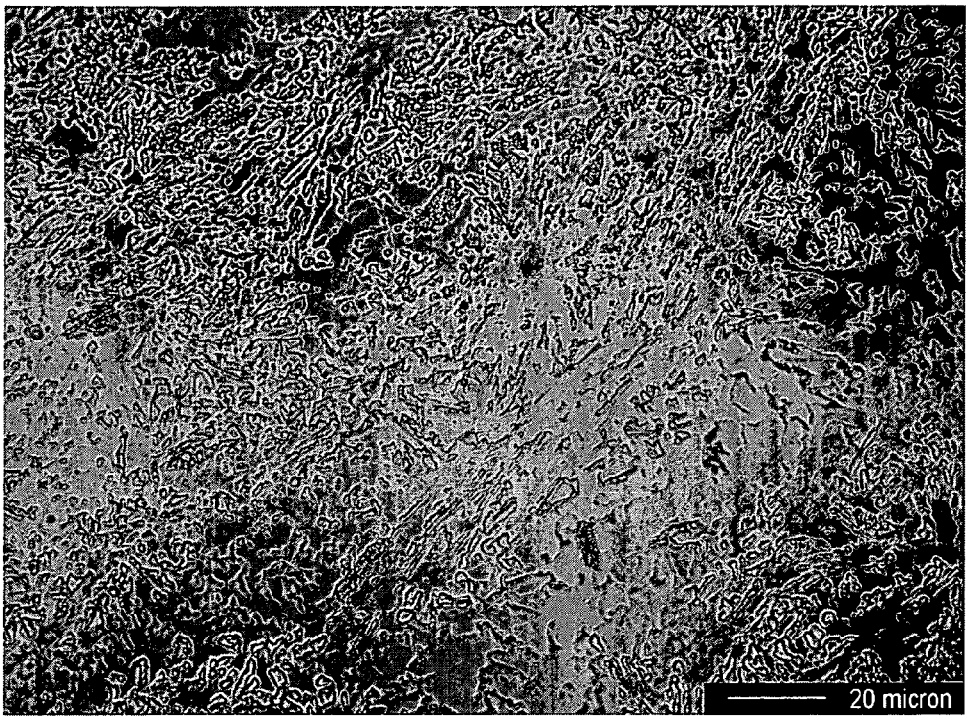
FIG. 6*a* is a photomicrograph showing the morphology of a transverse cross-section of a 12 mm, drop-cast, base alloy of the formula $(Fe_{50}Y_{1.5}Mo_{14}Cr_{14}C_{16}B_6)_{100-x}Mn_x$ where x=9.9, in accordance with the present invention.
Figure 6B:
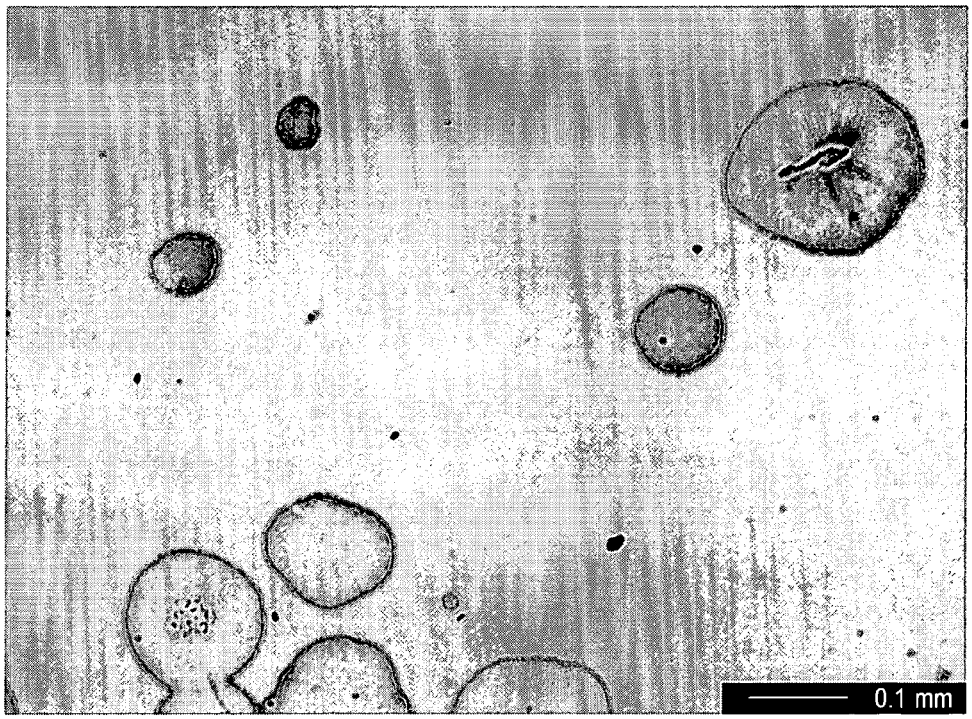
FIG. 6*b* is a photomicrograph showing the morphology of a transverse cross-section of a 12 mm, drop-cast, base alloy of the formula $(Fe_{50}Y_{1.5}Mo_{14}Cr_{14}C_{16}B_6)_{100-x}Mn_x$ where x=10.7, in accordance with the present invention.
Figure 6C:
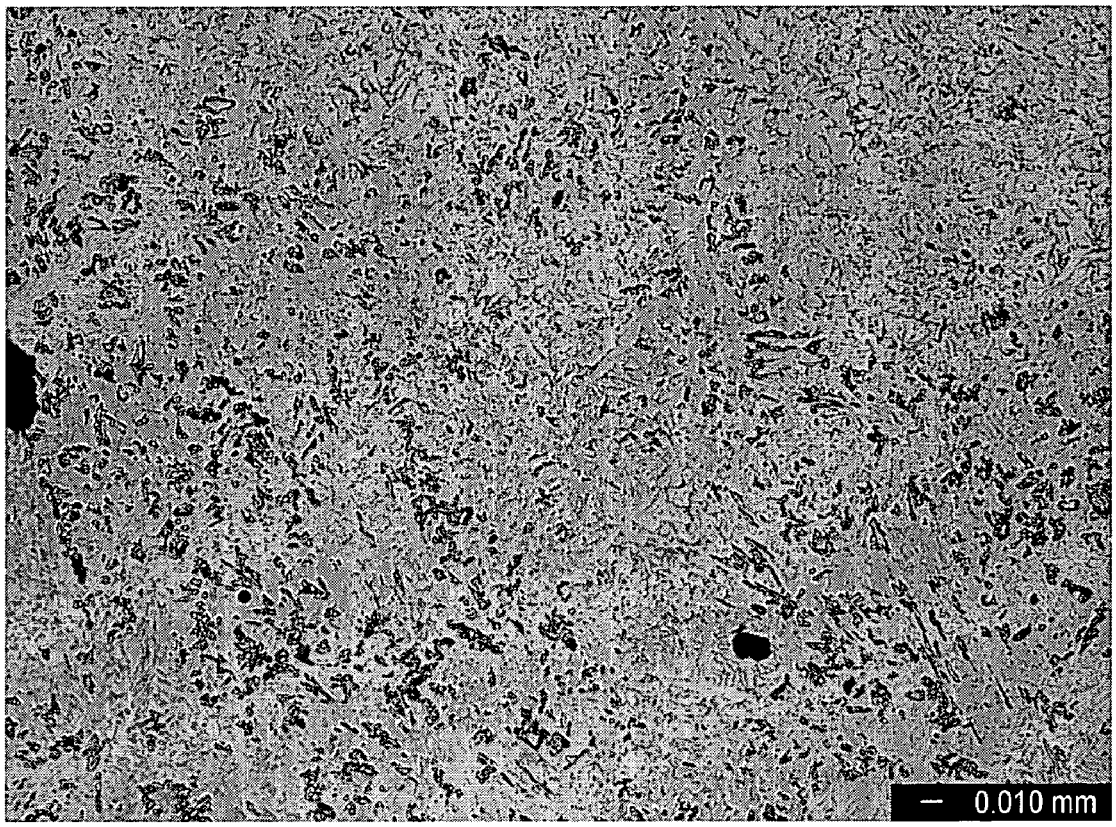
FIG. 6*c* is a photomicrograph showing the morphology of a transverse cross-section of a 12 mm, drop-cast, base alloy of the formula $(Fe_{50}Y_{1.5}Mo_{14}Cr_{14}C_{16}B_6)_{100-x}Mn_x$ where x=11.9, in accordance with the present invention.

In systems wherein the boron content is less than 10%, addition of Mn can facilitate GFA and the resulting alloys can be easily cast into glassy rods with at least 12 mm in diameter. It is preferable that the Mn content is no more than 25%, and more preferably, no more than 15%. FIGS. 6*a–c* show the central area of the transverse cross-section of the drop-cast, 12 mm and Mn-doped specimens for system $(Fe_{50}Y_{1.5}Mo_{14}Cr_{14}C_{16}B_6)_{100-x}Mn_x$ where x=9.9, 10.7 and 11.9%, respectively, indicating that the optimal content of Mn in these alloys is around 11%. As the Mn content diverges therefrom, crystalline phases are observed to precipitate in the center region of 12 mm casting rods, although the total volume fractions of these phases appear to be less than 15%.

Among other large elements, Mo and Al are likely preferable for industrial use due to their low cost and high resistance to oxidation. Mo was found to be beneficial to GFA, preferably, at a content of no more than 25%, and more preferably, in the range of 2% to 17%.

Effects of Intermediate Atoms

Figure 7:
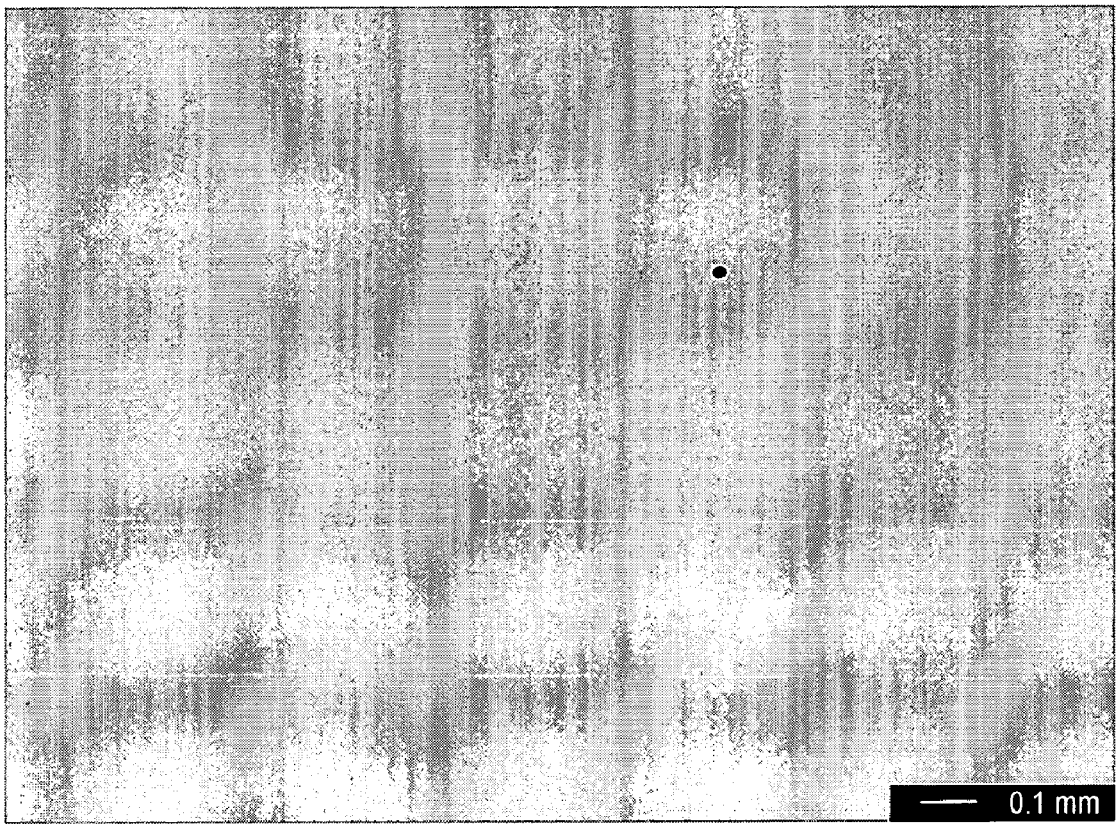
FIG. 7 is a photomicrograph showing the morphology of a transverse cross-section of a 12 mm, drop-cast, base alloy of the formula $Fe_{48.8-x}Y_{1.5}Mn_{10.7}Mo_{13.6}Cr_{39+x}C_{15.6}B_{5.8}$ where x=6, in accordance with the present invention.

One or a plurality of elements T selected from Co, Cu, Ni and Cr can be further added into the composition presented to increase GFA. From a production point of view, Co content should be as low as possible because of its high material cost. In the present invention, the element T is preferably represented by Cr, with a content below 25%, more preferably in the range 3 to 17%. For example, increasing Cr level can facilitate glass formation in system $Fe_{48.8-x}Y_{1.5}Mn_{10.7}Mo_{13.6}Cr_{3.9+x}C_{15.6}B_{5.8}$ (x=0, 2, 4 and 6), as shown in Table 1. FIG. 7 is the microphotograph of the central part of the cross-section of a drop-cast 12 mm rod for alloy $Fe_{48.8-x}Y_{1.5}Mn_{10.7}Mo_{13.6}Cr_{3.9+x}C_{15.6}B_{5.8}$ (x=6), which is alloy 33. With 3.9% Cr, a small portion of crystalline phases is still present in the central part of the casting rod, as shown in FIG. 6*b*. With the increasing Cr content, a featureless structure was seen over the whole sample, as shown in FIG. 7, suggesting that the growth of the crystalline phases presented in former alloy were successfully suppressed and the fully glass formation occurred in the latter. The synthesis of Fe-based amorphous alloys with an ingot diameter of 12 mm is unprecedented in the preparation of bulk metallic glasses.

Effects of Small Atoms

Elements B, C and Si are effective for enhancing the GFA in the present invention. The total content of one or combination of these particular elements ranges from 3 to 30%. A composition containing less than 3% or more than 30% of B, C and/or Si does not generally form amorphous phase using the copper mould drop-casting technique. More preferably, the content thereof is in the range of from 10 to 25%.

Figure 8A:
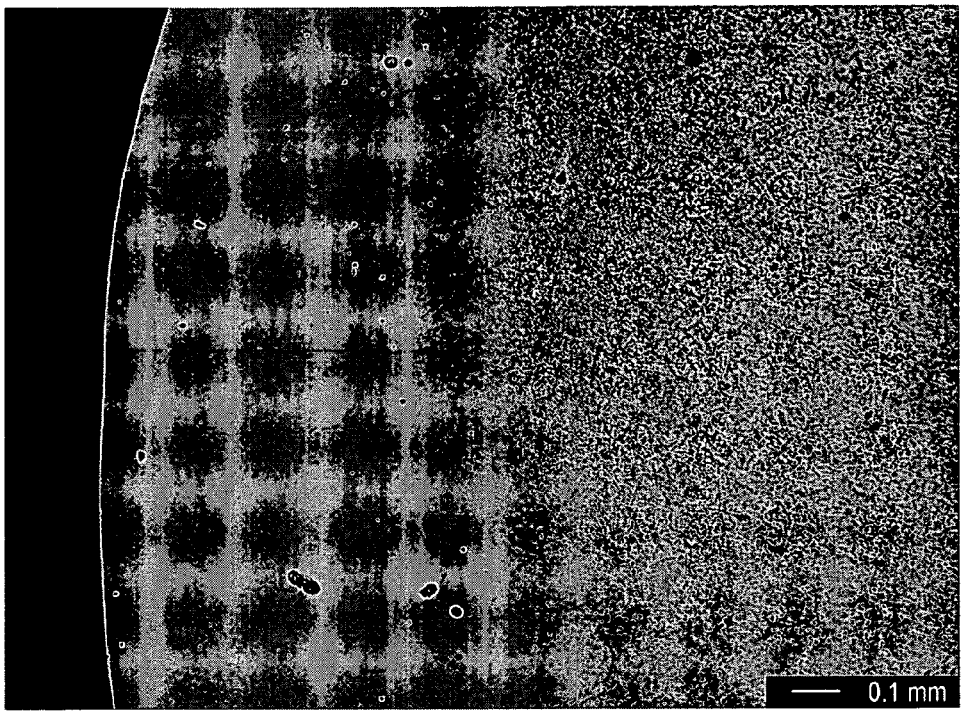
FIG. 8*a* is a photomicrograph showing the morphology of a transverse cross-section of a 7 mm, drop-cast, base alloy of the formula $(Fe_{50}Y_{1.5}Mn_{10}\ Mo_{14}Cr_4)_{78.3-x}(C_{16}B_6)_{21.7-x}$ where x=2, in accordance with the present invention.
Figure 8B:
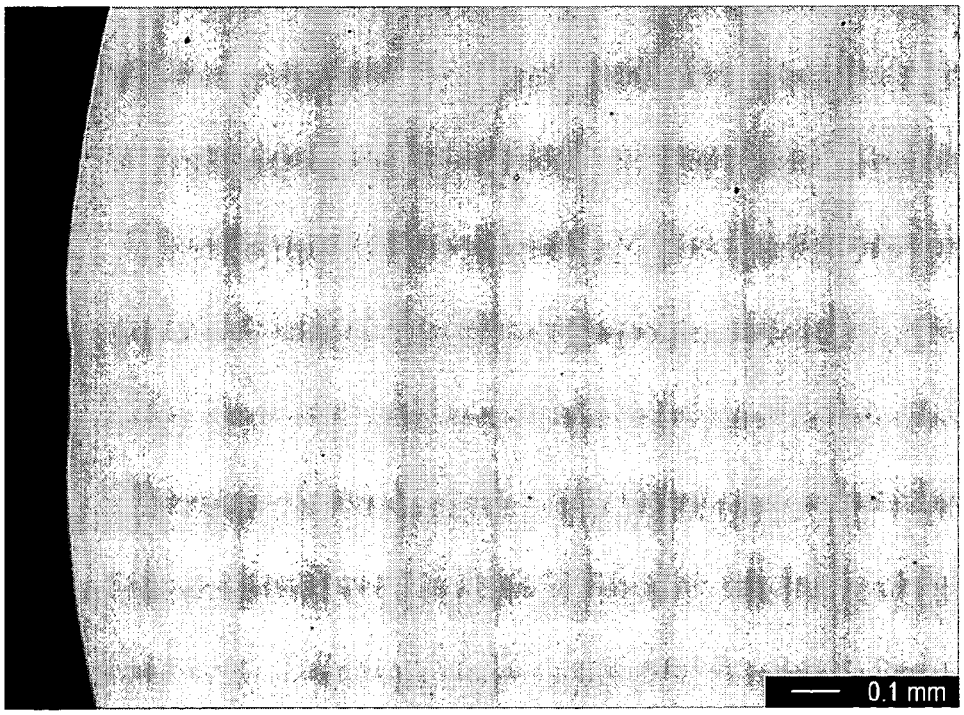
FIG. 8*b* is a photomicrograph showing the morphology of a transverse cross-section of a 7 mm, drop-cast, base alloy of the formula $(Fe_{50}Y_{1.5}Mn_{10}Mo_{14}Cr_4)_{78.3-x}(C_{16}B_6)_{21.7-x}$ where x=0, in accordance with the present invention.
Figure 8C:
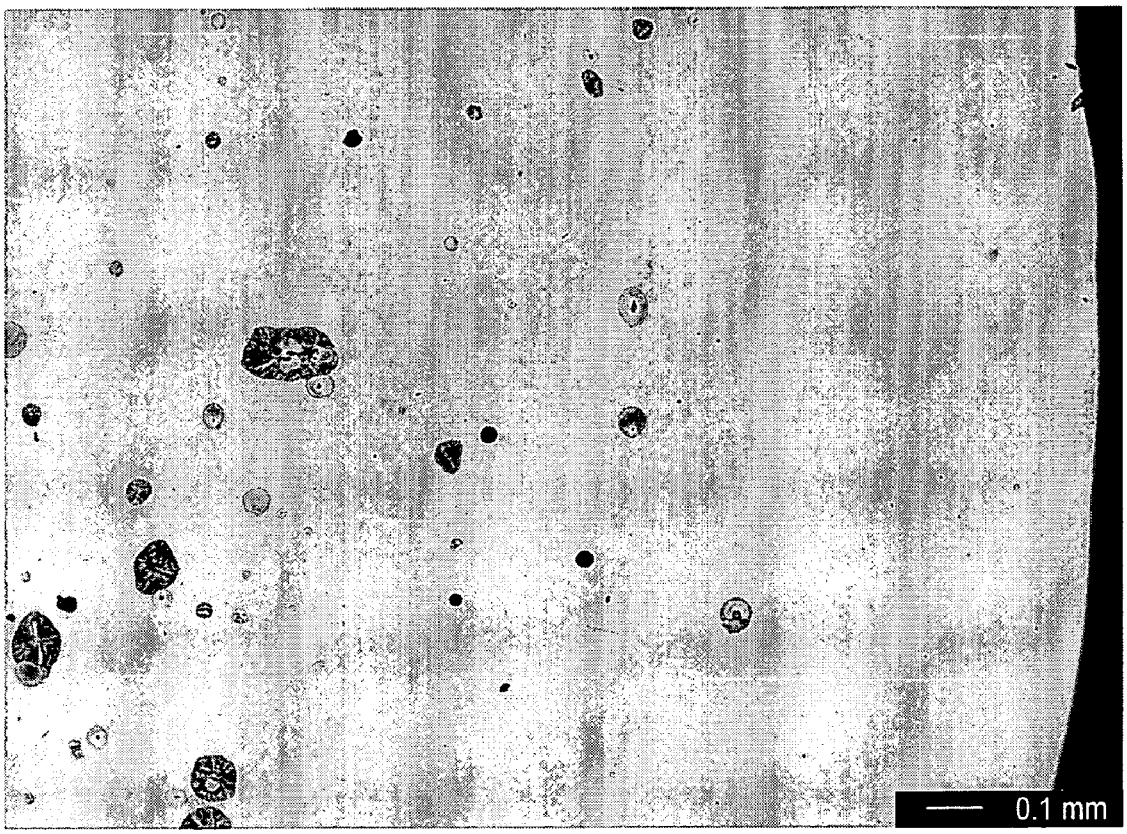
FIG. 8*c* is a photomicrograph showing the morphology of a transverse cross-section of a 7 mm, drop-cast, base alloy of the formula $(Fe_{50}Y_{1.5}Mn_{10}Mo_{14}Cr_4)_{78.3-x}(C_{16}B_6)_{21.7-x}$ where x=−2, in accordance with the present invention.

Moreover, the optimal amount of B, C, and/or Si is sensitive to other constituent elements in the system. For example, this is shown in FIGS. 8*a–c*, which show the microstructure change of the edge areas of 7 mm drop-cast cylindrical samples with different total amounts of B and C doped in $(Fe_{50}Y_{1.5}Mn_{10}Mo_{14}Cr_4)_{78.3-x}(C_{16}B_6)_{21.7-x}$ (x=2, 0, −2) alloys. FIG. 8*b* shows featureless microstructure obtained in for the specimen added with 21.7% of B and C (alloy 15). Decreasing the total content of B and C by as little as 2% had a negative effect on GFA; large areas of crystalline phases appeared in the interior part of the rod, as shown in FIG. 8*b*. Increasing the content of B and C to 23.7% (alloy 25) caused precipitation of some primary phases, although amorphous phases are still predominant, as shown in FIG. 8*c*. The data suggested that an optimum dose of B and C in this particular system is around 21.7%. Therefore, the content of small elements such as B, C, and Si should be carefully controlled in order to optimize GFA.

Based on the experimental data, 12 mm drop-cast rods of alloys 15, 29 and 30 (see Table I) comprise similar proportion of amorphous structure, indicating that Si can be substituted for B and/or C in the present invention.

In the present invention, it was also found that B content is preferably no more than 15%, more preferably no more than 9% when Mn is present in the alloy. Otherwise, Mn—B phases, for example $Mn_2B$ may form and thus degrade the GFA of the alloys.

Production of Fe based bulk amorphous alloys in the present invention was as follows: Firstly, a Fe-33% Y master alloy was prepared and cast into sheets. Subsequently, based on the desired compositional ranges described hereinabove, mixtures of alloying metals and the master alloy were arc-melted in an argon atmosphere to form an alloy of the desired composition, which was allowed to solidify into a homogeneous alloy. The alloy was then re-arc-melted over a copper mould in an argon atmosphere. The molten liquid was drop cast into the mould via gravity and the electromagnetic arc force. The copper moulds were 3–12 mm in diameter. The resultant cast samples were generally 50~70 mm in length. The morphologies of the samples were analyzed by microscopy, X-ray diffraction (XRD), and differential scanning calorimetry (DSC).

Figure 9A:
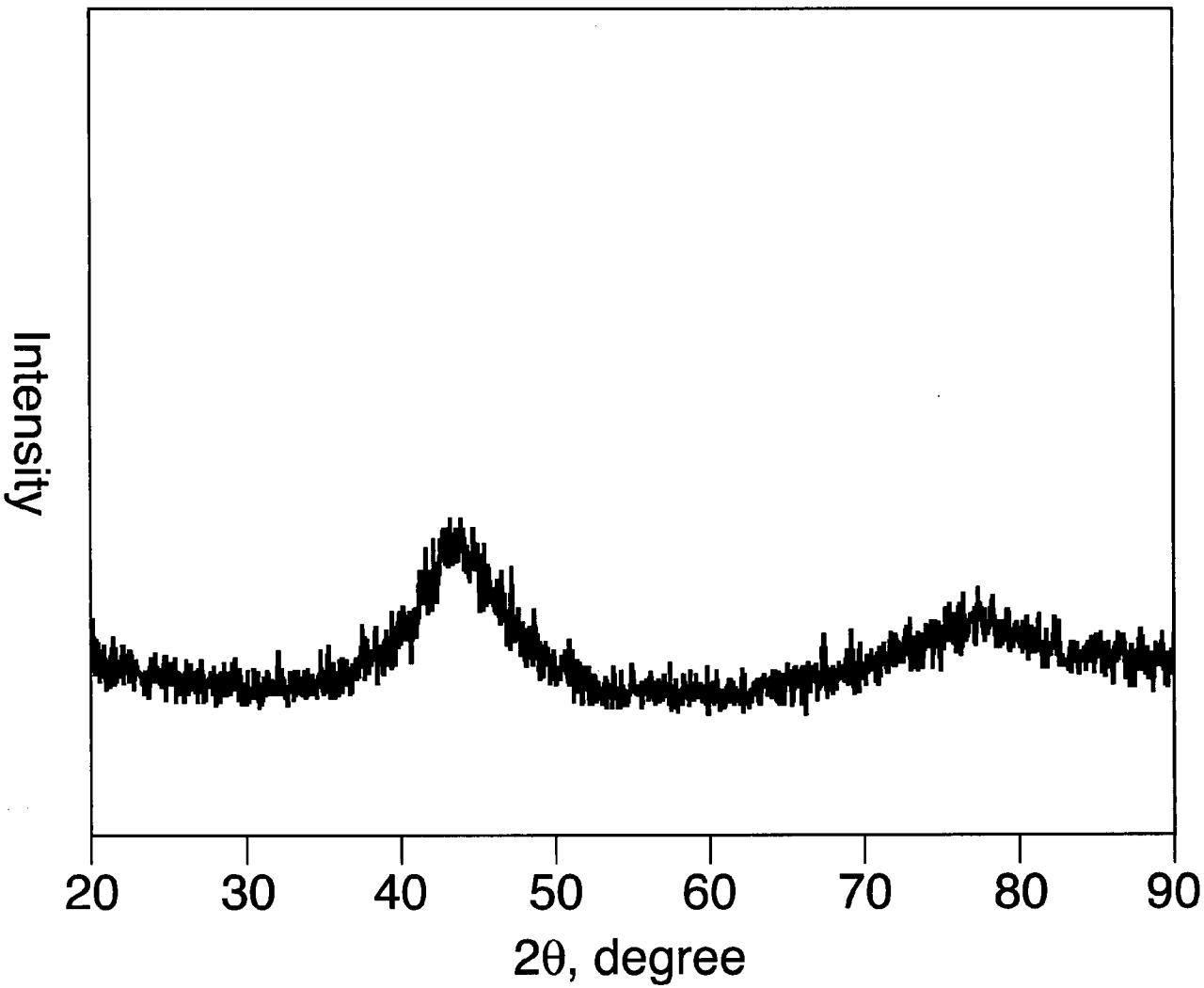
FIG. 9*a* is a graph showing an X-ray diffraction (XRD) pattern of the alloy shown in FIG. 7.
Figure 9B:
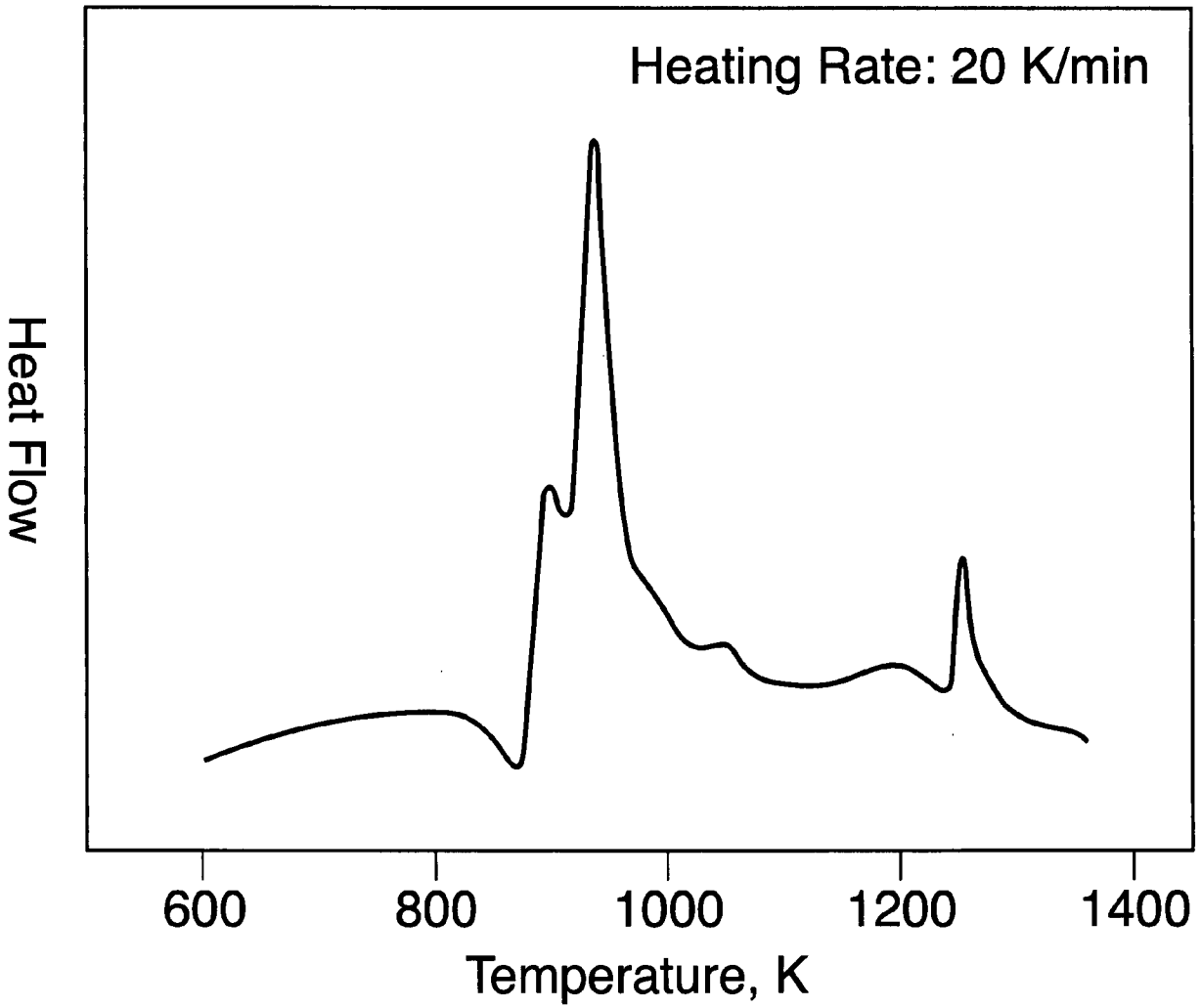
FIG. 9*b* is a graph showing a differential scanning calorimetry (DSC) trace of the alloy shown in FIG. 7.

Table 1 summarizes the alloy compositions which were drop-cast into a copper mold with diameters of 3 to 12 mm. Most of the compositions listed in Table 1 can be cast into rods of at least 5 mm with at least 70% amorphous structure. Some of the very good glass forming compositions, for example $(Fe_{43}Mo_{16}Cr_{16}C_{15}B_{10})_{98}Y_2$ (alloy 1), $(Fe_{50}Mo_{14}Mn_{10}Cr_4C_{16}B_6)_{100-x}Y_x$ (x=1.2~2.3, alloys 15, 16, 17 and 20), $Fe_{50-x}Mo_{14}Cr_{4+x}C_{16}B_6Y_{1.5})_{89.3}Mn_{10.7}$ (x=0 to 6, alloys 22, 31, 32 and 33), can form fully amorphous structure by drop cast into 7 mm rod with single amorphous phase. Particularly, for some of the best alloys, for example, $Fe_{48.8}Y_{1.5}Mn_{10.7}Mo_{13.7}Cr_{3.9}C_{15.6}B_{5.8}$ (alloy 22), $Fe_{46.8}Y_{1.5}Mn_{10.7}Mo_{13.7}Cr_{5.9}C_{15.6}B_{5.8}$ (alloy 31), $Fe_{44.8}Y_{1.5}Mn_{10.7}Mo_{13.7}Cr_{7.9}C_{15.6}B_{5.8}$ (alloy 32), $Fe_{42.8}Y_{1.5}Mn_{10.7}Mo_{13.7}Cr_{9.9}C_{15.6}B_{5.8}$ 33), and $(Fe_{45}Mo_{13}Mn_{11}Cr_{10-x}Co_xC_{16}B_6)_{98.5}Y_{1.5}$ (x=2 to 6, alloys 36, 38, 39, 41 and 43), a 12 mm diameter rod with single amorphous phase could be successfully made. As shown in FIG. 7, the central part of the transverse cross section in the cast 12 mm rod of alloy $Fe_{42.8}Y_{1.5}Mn_{10.7}Mo_{13.7}Cr_{9.9}C_{15.6}B_{5.8}$ (alloy 33) displays the highly desirable featureless structure, and no contrast corresponding to a crystalline phase is seen, although casting-induced pores distinguished as dark spots are observed. The corresponding X-ray diffraction (XRD) pattern and differential scanning calorimetry (DSC) trace for this alloy are shown in FIGS. 9*a* and 9*b*, respectively. No crystalline peak was observed in the XRD spectrum and typical glass transition and crystallization transformations were seen in the DSC scan. The glass transition temperature is around 840 K. All of these data confirm that the 12 mm as-cast cylinder sample is characterized by an essentially single amorphous structure.

The Fe based bulk amorphous alloys of the present invention can also be prepared by many, well known, conventional techniques, for example, water quenching, suction casting, wage casting, and powder metallurgy routes such as warm consolidation processing, etc. It is expected that larger sizes of glassy alloy articles can be fabricated using techniques with higher cooling capacities, for example, high-pressure suction casting, high-pressure injection casting, high-pressure die-casting, etc. Some special preparation techniques like flux melting are also contemplated to enhance GFA.

The hardness of the materials prepared as described hereinabove was measured by applying a load of 300 g using a conventional hardness tester. Bulk amorphous alloys of the present invention generally have extremely high hardness. Table 2 tabulates the hardness values for four alloys $(Fe_{43}Mo_{16}Cr_{16}C_{15}B_{10})_{98}Y_2$ (alloy 1), $(Fe_{50}Mo_{14}Mn_{10}Cr_4C_{16}B_6)_{98.8}Y_{1.2}$ (alloy 20), $(Fe_{50}Mo_{14}Mn_{10}Cr_{16}C_{15}B_{10})_{98}Y_2$ (alloy 1), $(Fe_{50}Mo_{14}Mn_{10}Cr_4C_{16}B_6)_{97.8}Y_{2.2}$ (alloy 17) in the amorphous region. As is clear from the results in Table 2, the bulk amorphous alloys within the range of the composition of the invention gave a Vickers harness value from Hv 1200 to 1400. High Vickers hardness values indicate extremely high strength of the material.

TABLE II

| Composition | Casting size, mm | Hardness, Hv |
|---|---|---|
| $(Fe_{43}Mo_{16}Cr_{16}C_{15}B_{10})_{98}Y_2$ | 5 | 1424 ± 23 |
| $(Fe_{50}Mo_{14}Mn_{10}Cr_4C_{16}B_6)_{98.8}Y_{1.2}$ | 7 | 1252 ± 22 |
| $(Fe_{50}Mo_{14}Mn_{10}Cr_4C_{16}B_6)_{98}Y_2$ | 7 | 1260 ± 20 |
| $(Fe_{50}Mo_{14}Mn_{10}Cr_4C_{16}B_6)_{97.7}Y_{2.3}$ | 7 | 1261 ± 19 |

The alloy of the present invention, exhibiting the unique combination of high GFA, the ability of being produced in bulk form with fully amorphous structure, very high strength and good magnetic properties is expected to have great potential for many structural and functional applications. Articles that can be formed of the compositions of the present invention include, but are not limited to, for example: machinery and machine components such as gears, shafts, levers, cams, etc.; structural articles and components such as frames, braces, plates, rods, bars, etc.; precision optical articles and components; dies; hand and power tools and components; medical instruments and components; cutting tools, instruments and components; springs and other resilient articles and components; molds, equipment and components for high-resolution replication; armor-piercing projectiles and other weapons components; and recreational articles such as fishing rods, tennis rackets, golf club components, and bicycle components.

High GFA is generally related to high thermal stability. Bulk amorphous alloys have the ability to be manufactured near net shape. Therefore, the alloys of the present invention can be used in the fabrication of articles having fine surface irregularities such as, for example, gears, milling heads, golf club shafts, and golf club heads.

Fe based bulk metallic glasses generally display very good magnetic properties. Sometimes the annealing process of bulk amorphous materials can result in even better magnetic characteristics. Therefore, the alloys of the present invention can be used to fabricate articles such as, for example: core materials in energy-efficient electrical power devices, high efficiency electrical transformers, air conditioners, and the like; electronic surveillance equipment; magnetic sensors; automotive magnetic equipment; efficient electrodes; and writing appliance materials.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A bulk amorphous alloy comprising the approximate composition:

$Fe_{(100-a-b-c-d-e)}Y_aMn_bT_cM_dX_e$ wherein:

a. T comprises at least one element selected from the group consisting of: Ni, Cu, Cr and Co;

b. M comprises at least one element selected from the group consisting of W, Mo, Nb, Ta, Al and Ti;

c. X comprises at least one element selected from the group consisting of B, C and Si;

d. a is an atomic percentage, and $0.5<a<5$;

e. b is an atomic percentage, and $1<b<25$;

f. c is an atomic percentage, and $0<c<25$;

g. d is an atomic percentage, and $0<d<25$; and h. e is an atomic percentage, and $5<e<30$.

2. A bulk amorphous alloy composition in accordance with claim 1 wherein X further comprises $C_fB_g$ wherein:

a. $f+g=e$;

b. $0<f<25$; and c. $0<g<15$.

3. A bulk metallic glass in accordance with claim 2 further comprising the approximate composition $Fe_{(100-a-b-h-i-f-g)}Y_aMn_bCr_hMo_iC_fB_g$ wherein:

a. $0.5\leqq a\leqq 3$;

b. $1\leqq b\leqq 15$;

c. $3\leqq h\leqq 17$;

d. $2\leqq i\leqq 17$;

e. $5\leqq f\leqq 20$; and f. $2\leqq g\leqq 9$.

4. A bulk amorphous alloy composition in accordance with claim 2 further comprising the approximate composition $Fe_{49}Y_2Mn_{9.8}Mo_{13.7}Cr_{3.9}C_{15.7}B_{5.9}$.

5. A bulk amorphous alloy composition in accordance with claim 2 further comprising the approximate composition $Fe_{49.2}Y_{1.5}Mn_{9.9}Mo_{13.8}Cr_{3.9}C_{15.8}B_{5.9}$.

6. A bulk amorphous alloy composition in accordance with claim 2 further comprising the approximate composition $Fe_{48.8}Y_{1.5}Mn_{10.7}Mo_{13.7}Cr_{3.9}C_{15.6}B_{5.8}$.

7. A bulk amorphous alloy composition in accordance with claim 2 further comprising the approximate composition $Fe_{49.2}Y_{1.5}Si_{0.5}Mn_{9.9}Mo_{13.8}Cr_{3.9}C_{15.4}B_{5.8}$.

8. A bulk amorphous alloy composition in accordance with claim 2 further comprising the approximate composition $Fe_{46.8}Y_{1.5}Mn_{10.7}Mo_{13.7}Cr_{5.9}C_{15.6}B_{5.8}$.

9. A bulk amorphous alloy composition in accordance with claim 2 further comprising the approximate composition $Fe_{44.8}Y_{1.5}Mn_{10.7}Mo_{13.7}Cr_{7.9}C_{15.6}B_{5.8}$.

10. A bulk amorphous alloy composition in accordance with claim 2 further comprising the approximate composition $Fe_{42.8}Y_{1.5}Mn_{10.7}Mo_{13.7}Cr_{9.9}C_{15.6}B_{5.8}$.

11. A bulk amorphous alloy composition in accordance with claim 2 further comprising the approximate composition $(Fe_{45}Mo_{13}Mn_{11}Cr_{10-x}Co_xC_{16}B_6)_{98.5}Y_{1.5}$ wherein $2\leqq x\leqq 6$.

12. A bulk amorphous alloy composition in accordance with any one of claims 1–3 or 4–11, inclusive, wherein said bulk amorphous alloy composition is formed into an article.

* * * * *